US010543688B2

(12) United States Patent
Ito et al.

(10) Patent No.: US 10,543,688 B2
(45) Date of Patent: Jan. 28, 2020

(54) RECORDING APPARATUS WITH AN ELECTRIC FIELD FORMING SECTION

(71) Applicant: SEIKO EPSON CORPORATION, Tokyo (JP)

(72) Inventors: Tatsuya Ito, Shiojiri (JP); Satoshi Yoshino, Matsumoto (JP); Makoto Sato, Matsumoto (JP); Kensuke Tamai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/030,454

(22) Filed: Jul. 9, 2018

(65) Prior Publication Data

US 2019/0016138 A1 Jan. 17, 2019

(30) Foreign Application Priority Data

Jul. 12, 2017 (JP) ..... 2017-136299

(51) Int. Cl.
*B41J 2/165* (2006.01)
*B41J 2/14* (2006.01)

(52) U.S. Cl.
CPC ..... *B41J 2/16517* (2013.01); *B41J 2/14314* (2013.01)

(58) Field of Classification Search
CPC ..... B41J 2/16517; B41J 2/095; B41J 29/13; B41J 2/1714; B41J 11/0065; B41J 2/14314
See application file for complete search history.

(56) References Cited

U.S. PATENT DOCUMENTS

2003/0151639 A1 8/2003 Takahashi
2005/0206682 A1* 9/2005 Togashi ..... B41J 2/04541 347/55
2007/0091146 A1* 4/2007 Endo ..... B41J 2/04 347/55
2008/0284822 A1* 11/2008 Oki ..... B41J 2/1714 347/55
2009/0015638 A1* 1/2009 Umezawa ..... B41J 2/2125 347/55
2012/0212531 A1* 8/2012 Yamada ..... B41J 2/14072 347/10
2015/0352846 A1 12/2015 Miyakoshi et al.
2016/0243834 A1* 8/2016 Nakagawa ..... B41J 29/377

FOREIGN PATENT DOCUMENTS

JP 2004-202867 A 7/2004
JP 2008-074048 A 4/2008
JP 2015-229273 A 12/2015
JP 2017-056676 A 3/2017

* cited by examiner

*Primary Examiner* — Bradley W Thies
(74) *Attorney, Agent, or Firm* — Workman Nydegger

(57) ABSTRACT

A recording apparatus includes an electric field forming section including a conductive member and configured to form an electric field, and the conductive member includes at least one first portion and a second portion, each of the at least one first portion being disposed at a position being nearer the recording head than a position of the second portion and included in a corresponding one of at least one liquid discarding region each of which, in an execution of borderless recording, is used for the ejection of the liquid onto an outside of a corresponding one of at least one edge whose position corresponds to each of at least one predetermined size of a medium, the second portion being disposed in a recording region other than the at least one liquid discarding region.

8 Claims, 17 Drawing Sheets

RECORDING APPARATUS WITH AN ELECTRIC FIELD FORMING SECTION

BACKGROUND

1. Technical Field

The present invention relates to recording apparatuses that perform recording by ejecting liquid onto a medium.

2. Related Art

In ink jet printers (hereinafter referred to as just printers) serving as the recording apparatuses and configured to perform recording by ejecting ink as the liquid from a recording head thereof, when the ink is ejected from the recording head, ink mist sometimes arises as the result of the change of the ejected ink into ink in a mist state (this ink mist being sometimes referred to as just "mist" hereinafter).

Further, the mist floats and travels around to an upper portion of a carriage including the recording head. Further, the mist is sometimes adhered onto, for example, an ink cartridge mounted in the carriage. In the case where the mist is adhered on the ink cartridge, there is a risk that, when a user replaces the ink cartridge, the mist may soil the user's hand. Further, in the case where the mist is adhered on a nozzle forming face of the recording head, there is a risk that a defect may occur in the ejection of the ink, and the defect may degrade the quality of recorded images.

For this reason, among the printers, there are some types of printers in which a mist collecting mechanism for collecting the floating mist is provided at a position adjacent to the recording head. Further, as a configuration example of the mist collecting mechanism, there is a configuration including an absorbing member for absorbing the mist, and a mist attracting mechanism portion for attracting the mist to the side of the absorbing member. Specifically, an electrode plate serving as the mist attracting mechanism portion is provided on the side of a medium supporting portion facing the recording head, and a voltage is applied to the electrode plate to positively charge the electrode plate so as to cause the mist (normally, being negatively charged) to be attracted to the side of the medium supporting portion and allow the absorbing member included in the medium supporting portion to absorb the mist. In JP-A-2004-202867, as a configuration of the mist attracting mechanism portion, there is disclosed a configuration that allows a constant voltage to be applied to the electrode plate to cause an electric potential difference between the electrode plate and the recording head and thereby cause the mist to be attracted to the side of the electrode plate.

By the way, among the printers, there are some types of printers that are capable of performing recording across the entire face of the medium, that is, so-called borderless recording. The mist is likely to largely arise at borders of the medium, at which the ejected ink is discarded at the time of the execution of the borderless recording. In order to increase the collection efficiency for the mist at positions corresponding to the respective borders of the medium which become discarding regions for the discarded, ejected ink, it is preferable to employ a configuration that allows the voltage applied to the electrode plate to be increased so as to bring the electrode plate into a strongly charged state.

Here, in the case where, like the configuration disclosed in JP-A-2004-202867, a constant voltage is applied to the electrode plate to cause an electric potential difference between the electrode plate and the recording head, when the above configuration, which allows the voltage applied to the electrode plate to be increased so as to bring the electrode plate into a strongly charged state, is employed, the mist collection efficiency is increased because the mist is strongly attracted to the side of the electrode plate, but the electrode plate also attracts ink droplets that form images on the medium. As a result, there is a risk that misalignments among the landing positions of the ink droplets may occur, and such misalignments may degrade the quality of recorded images. On the contrary, when the electrode plate is not strongly charged, a situation where the collection of the mist is insufficient may occur. For this reason, it has been difficult to apply, to the electrode plate, a high voltage enough to effectively collect a large amount of mist that arises in the discarding regions for the discarded, ejected ink at the time of the execution of the borderless recording.

SUMMARY

An advantage of some aspects of the invention is that a recording apparatus is provided that minimizes adverse influences on the quality of recorded images, and concurrently enables ink mist that largely arises in one or more discarding regions for the discarded, ejected ink at the time of the execution of borderless recording to be effectively collected.

According to a first configuration of a recording apparatus according to an aspect of the invention, the recording apparatus includes a recording head including nozzles through which liquid is ejected onto a transported medium, and an electric field forming section including a conductive member and configured to, upon supply of a voltage to the conductive member, form an electric field between a nozzle forming face of the recording head and a nozzle facing portion facing the nozzle forming face. Here, the conductive member includes at least one first portion located near the recording head, and a second portion located further away from the recording head than the at least one first portion. Further, each of the at least one first portion is disposed at a position included in a corresponding one of at least one liquid discarding region each of which, in an execution of borderless recording for ejecting the liquid onto both of an outside and an inside of each of at least one edge among edges of the medium, is used for the ejection of the liquid onto the outside of a corresponding one of the at least one edge whose position corresponds to each of at least one predetermined size of the medium. Further, the second portion is disposed in a recording region other than the at least one liquid discarding region.

In this first configuration, the electric field forming section, which includes the conductive member and forms the electric field between the nozzle forming face and the nozzle facing portion by applying an voltage to the conductive member, is capable of attracting mist that arises when the liquid is ejected from the recording head, toward the conductive member side. In this case, the conductive member includes the at least one first portion, located near the recording head, and the second portion, located further away from the recording head than the at least one first portion, and thus, for each of the at least one first portion, a strong electric field is generated between the recording head and the each first portion; while, for the second portion, an electric field weaker than that for the each first portion is generated between the recording head and the second portion. That is, applying a constant voltage to the conductive member enables two kinds of electric fields having mutually different strengths to be respectively generated for the each first portion and the second field. The voltage applied to the conductive member is constant, and thus, the first configuration eliminates the risk that such an electric field that influences the positions of the landing of the liquid onto the medium is generated at the boundary between the each first portion and the second portion.

Further, the each first portion, for which the strong electric field is generated between the recording head and the each first portion, is disposed in a corresponding one of the at least one liquid discarding region in which mist is likely to arise at the time of the execution of the borderless recording, and thus, this configuration brings about a high mist attraction effect in each of the at least one liquid discarding region. Further, the second portion, for which the electric field weaker than that for the each first portion is generated between the recording head and the second portion, is disposed in the recording region other than the at least one liquid discarding region, and thus, this configuration reduces the risk that the liquid for use in the recording on the medium is attracted by the strong electric field, and thereby the quality of recorded images is degraded.

According to a second configuration of the recording apparatus according to the aspect of the invention, in the above first configuration, the recording apparatus may further include a first absorbing member provided on a side of the nozzle facing portion and configured to absorb the liquid.

This second configuration enables the mist having been attracted by the electric field forming section to be collected by allowing the first absorbing member to absorb the mist.

According to a third configuration of the recording apparatus according to the aspect of the invention, in the above second configuration, the conductive member may be provided between the first absorbing member and the recording head.

According to this third configuration, the conductive member is provided between the first absorbing member and the recording head. The third configuration, therefore, minimizes, for example, the adhesion of the liquid having been absorbed by the first absorbing member onto the medium being transported.

According to a fourth configuration of the recording apparatus according to the aspect of the invention, in any one of the above first to third configurations, the recording apparatus may further include a carriage including a bottom face portion provided with at least one portion through which the nozzle forming face of the recording head is exposed, the carriage being configured to reciprocate in a scanning direction of the recording head, and a second absorbing member provided within a region of the reciprocation of the carriage and configured to absorb the liquid. Further, the carriage is configured to be displaced in a direction in which the nozzle forming face advances/retracts relative to the nozzle facing portion, and has an advanced state in which at least one portion of the bottom face portion is in contact with the second absorbing member, and a retracted state in which the bottom face portion is retracted from a position of the advanced state to a position away from the second absorbing member.

This fourth configuration enables the achievement of a configuration that allows the second absorbing member to absorb the liquid having been adhered on at least one portion of the bottom face portion of the carriage being reciprocated in the scanning direction of the recording head. The carriage is configured to be capable of being displaced in a direction in which the nozzle forming face advances/retracts relative to the nozzle facing portion, and is capable of taking an advanced state in which at least one portion of the bottom face portion is in contact with the second absorbing member, and a retracted state in which the bottom face portion is retracted from a position of the advanced state to a position away from the second absorbing member, thus enabling the carriage to, at the time when the recording is performed, be brought into the retracted state and reciprocate in the scanning direction of the recording head without any contact with the second absorbing member.

According to a fifth configuration of the recording apparatus according to the aspect of the invention, in the above fourth aspect, within the region of the reciprocation of the carriage, the second absorbing member may be disposed on a second end side located opposite a first end side on which a home position of the carriage is provided, and, in the advanced state, the second absorbing member is in contact with a portion constituting the bottom face portion of the carriage and located further toward the second end side than the nozzle forming face.

The floating mist is sometimes adhered onto the bottom face portion of the carriage. When the adhered mist gathers and forms liquid, and the liquid accumulates, there is a risk that the accumulated liquid drips down and the dripped liquid soils the medium. Here, the fifth configuration enables the achievement of a configuration that, on a side opposite the home position of the carriage within the region of the reciprocation of the carriage, allows the second absorbing member to absorb the liquid having been adhered on a portion located further toward the second end side than the nozzle forming face in the bottom face portion of the carriage.

According to a sixth configuration of the recording apparatus according to the aspect of the invention, in any one of the above first to third configurations, the recording apparatus may further include a recording unit including a bottom face portion provided with at least one portion through which the nozzle forming face of the recording head is exposed, and a concave and convex shaped portion configured to retain the liquid utilizing surface tension may be provided in at least one portion of the bottom face portion of the recording unit.

According to this sixth configuration, the concave and convex shaped portion capable of retaining the liquid utilizing the surface tension is provided in at least one portion of the bottom face portion of the recording unit. The sixth configuration, therefore, reduces the risk that the liquid having been adhered on the bottom face portion of the recording unit drips down.

According to a seventh configuration of the recording apparatus according to the aspect of the invention, in any one of the above first to three configurations, the recording apparatus may further include a recording unit including a bottom face portion provided with at least one portion through which the nozzle forming face of the recording head is exposed. Further, at least one groove portion may be provided in at least one portion of the bottom face portion of the recording unit, and a third absorbing member may be provided in the bottom face portion. The at least one groove portion may be configured to guide liquid having been adhered on the bottom face portion to the third absorbing member.

According to this seventh configuration, the at least one groove portion provided on the bottom face portion of the recording unit guides the liquid having been adhered on the bottom face portion to the third absorbing member. The seventh configuration, therefore, allows the third absorbing member to absorb liquid having accumulated on the bottom face portion of the carriage, and thereby reduces the risk that the accumulated liquid drips down.

According to an eighth configuration of the recording apparatus according to the aspect of the invention, in any one of the above first to seventh configurations, a second conductive member may be provided between the recording head and the conductive member.

According to this eighth configuration, when a voltage is applied to the conductive member, an electric field is generated between the conductive member and the second conductive member. The eighth configuration, therefore, reduces the risk that the mist is adhered onto the recording head.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

First, the outline of a recording apparatus according to an embodiment of the invention will be described. In the present embodiment, an ink jet printer 1 will be exemplified as an example of the recording apparatus. The ink jet printer 1 will be referred to as just a printer 1 hereinafter.

Figure 1:
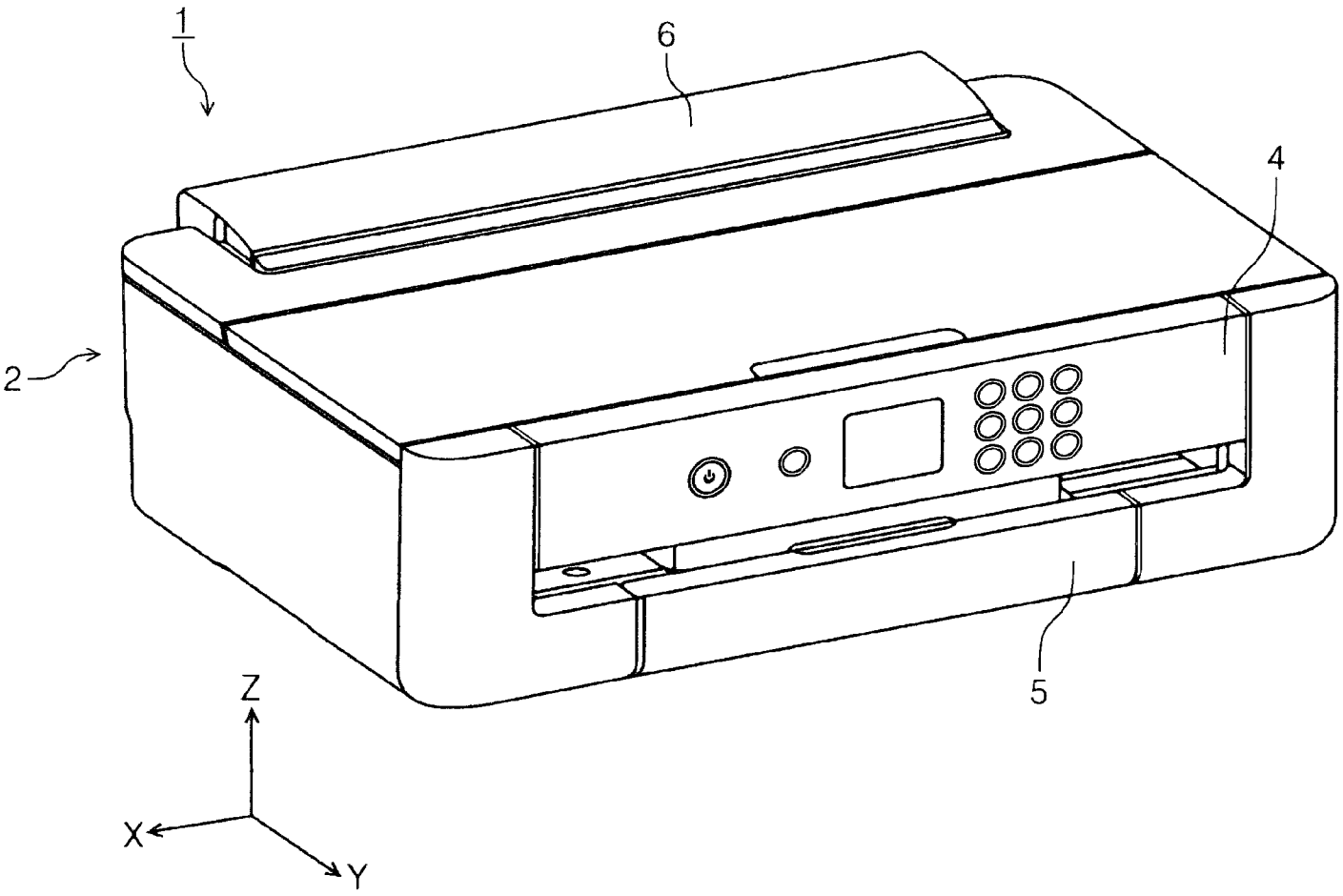
FIG. 1 is a perspective, external view of a printer according to an embodiment of the invention.
Figure 2:
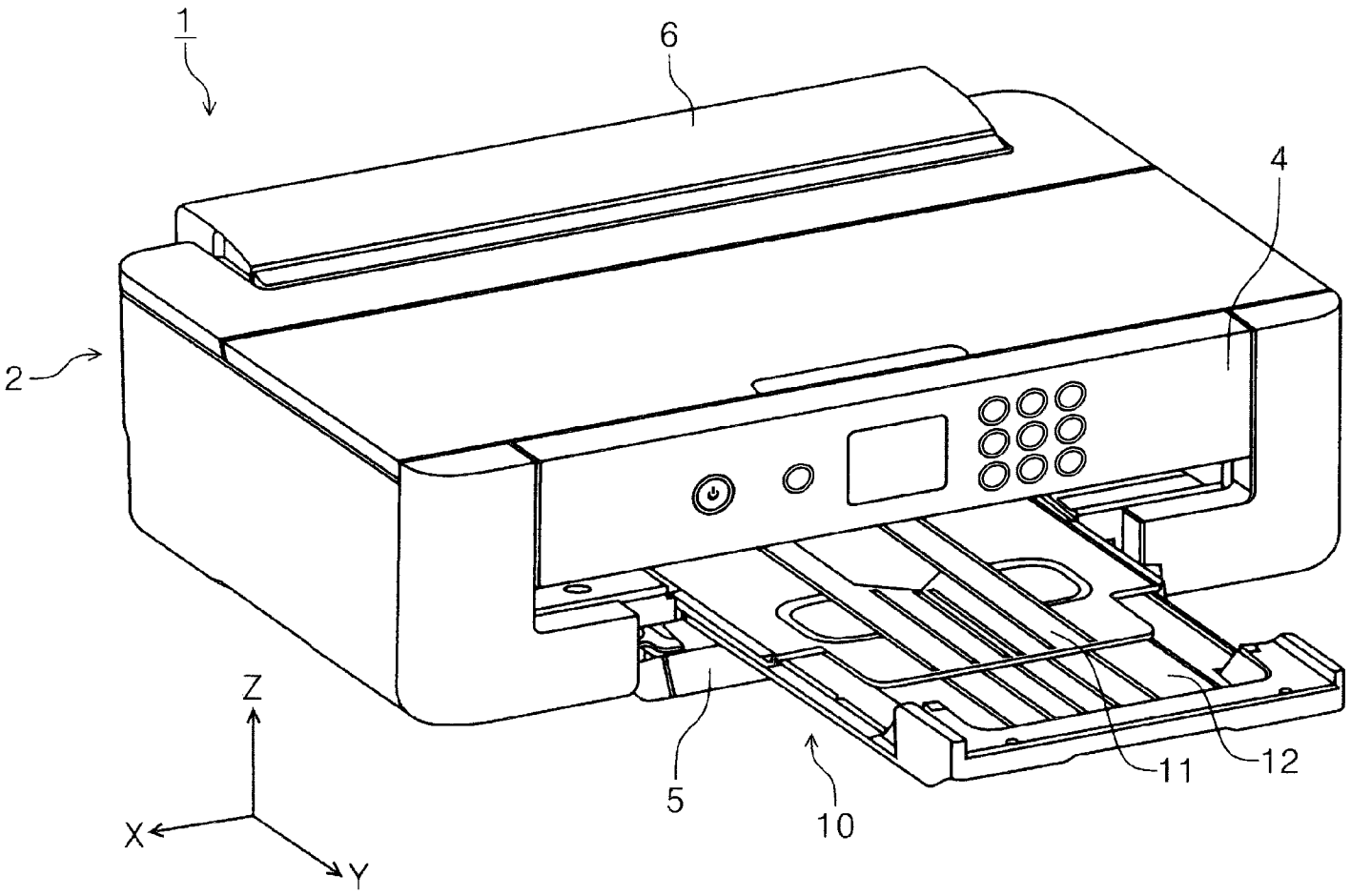
FIG. 2 is a diagram illustrating a deployed state of a discharged paper tray in the printer, according to the embodiment of the invention.
Figure 3:
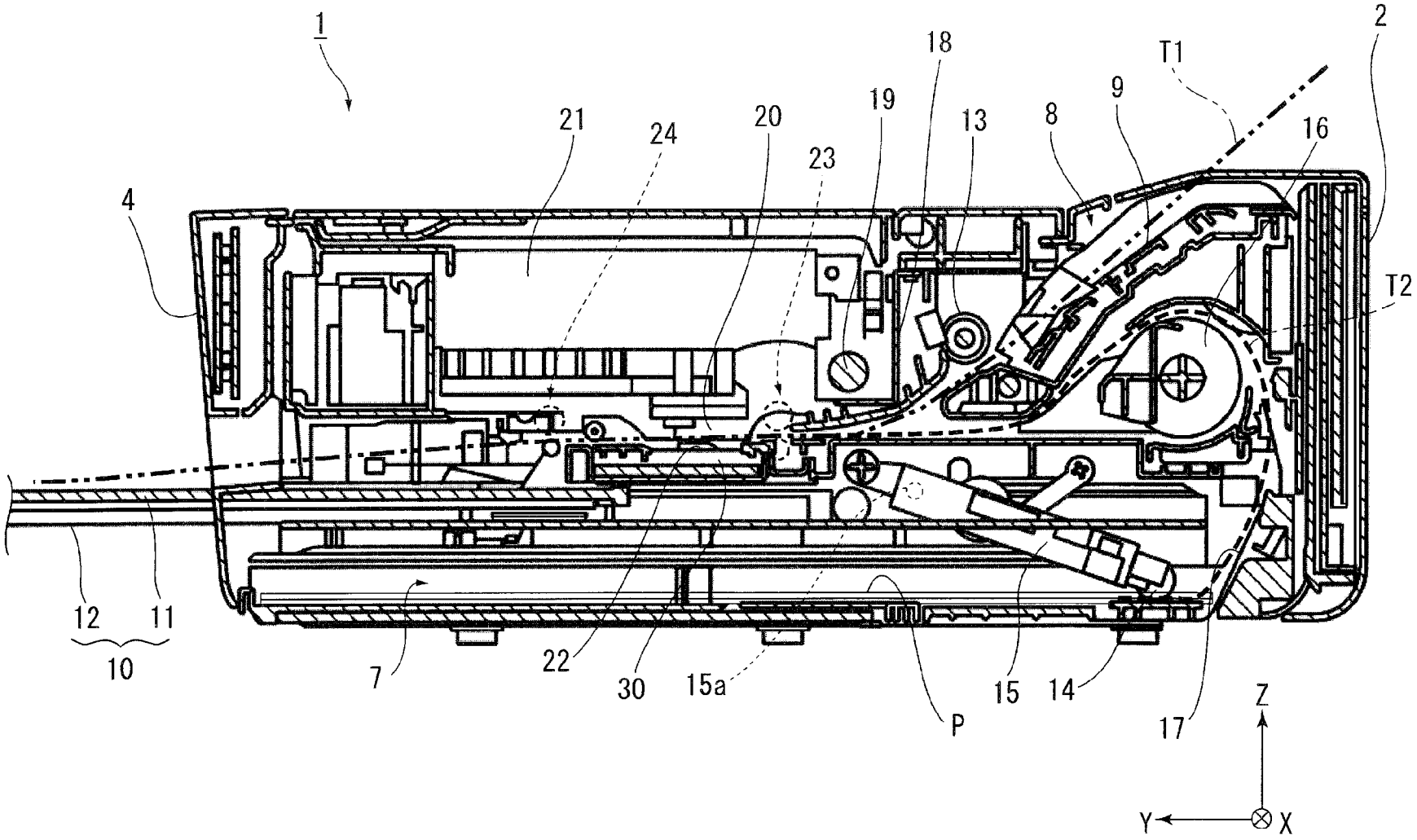
FIG. 3 is a diagram illustrating a paper transport path of the printer, according to the embodiment of the invention.
Figure 4:
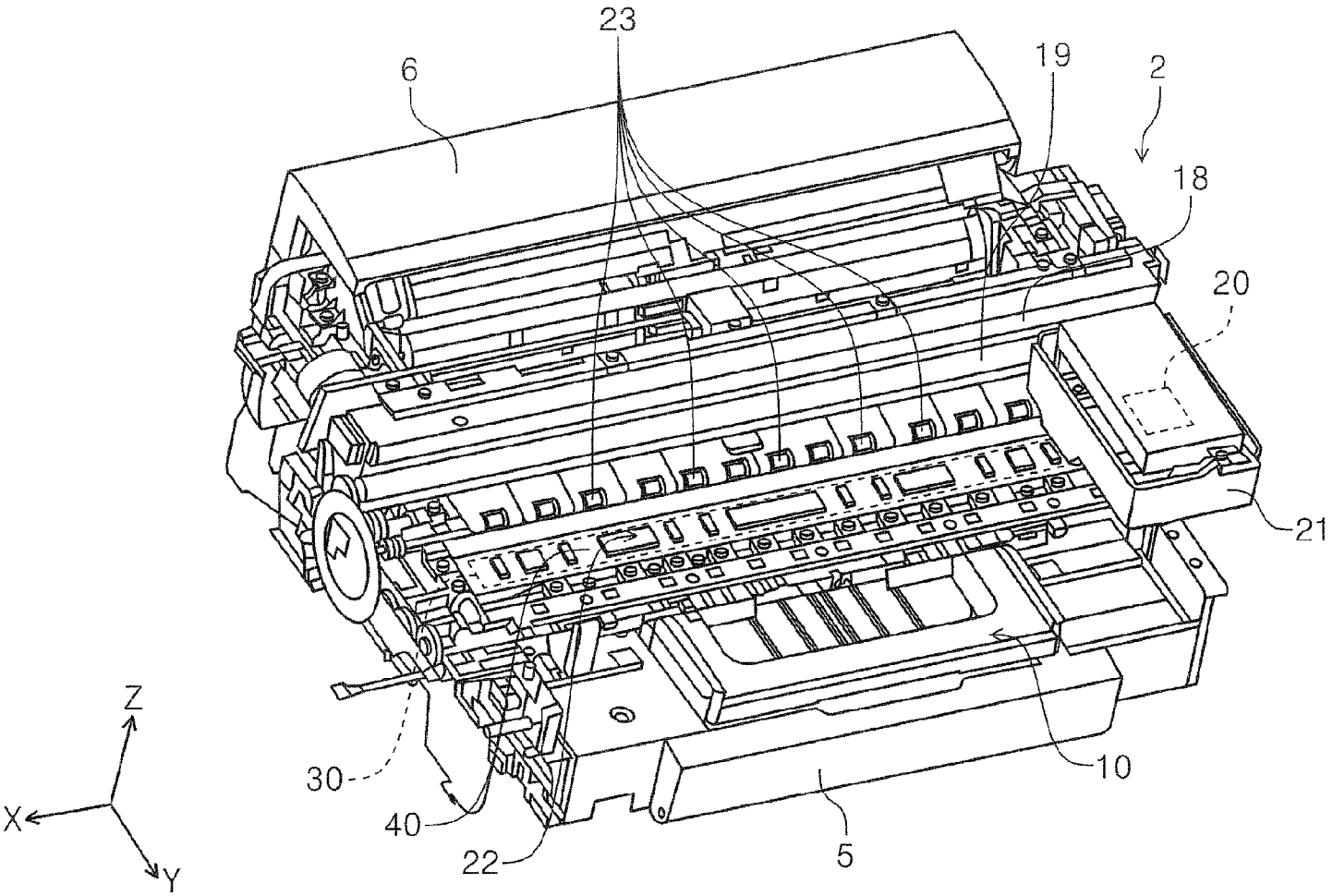
FIG. 4 is a perspective view of the printer, illustrating a state in which the outer covering of an apparatus body of the printer is removed.
Figure 5:
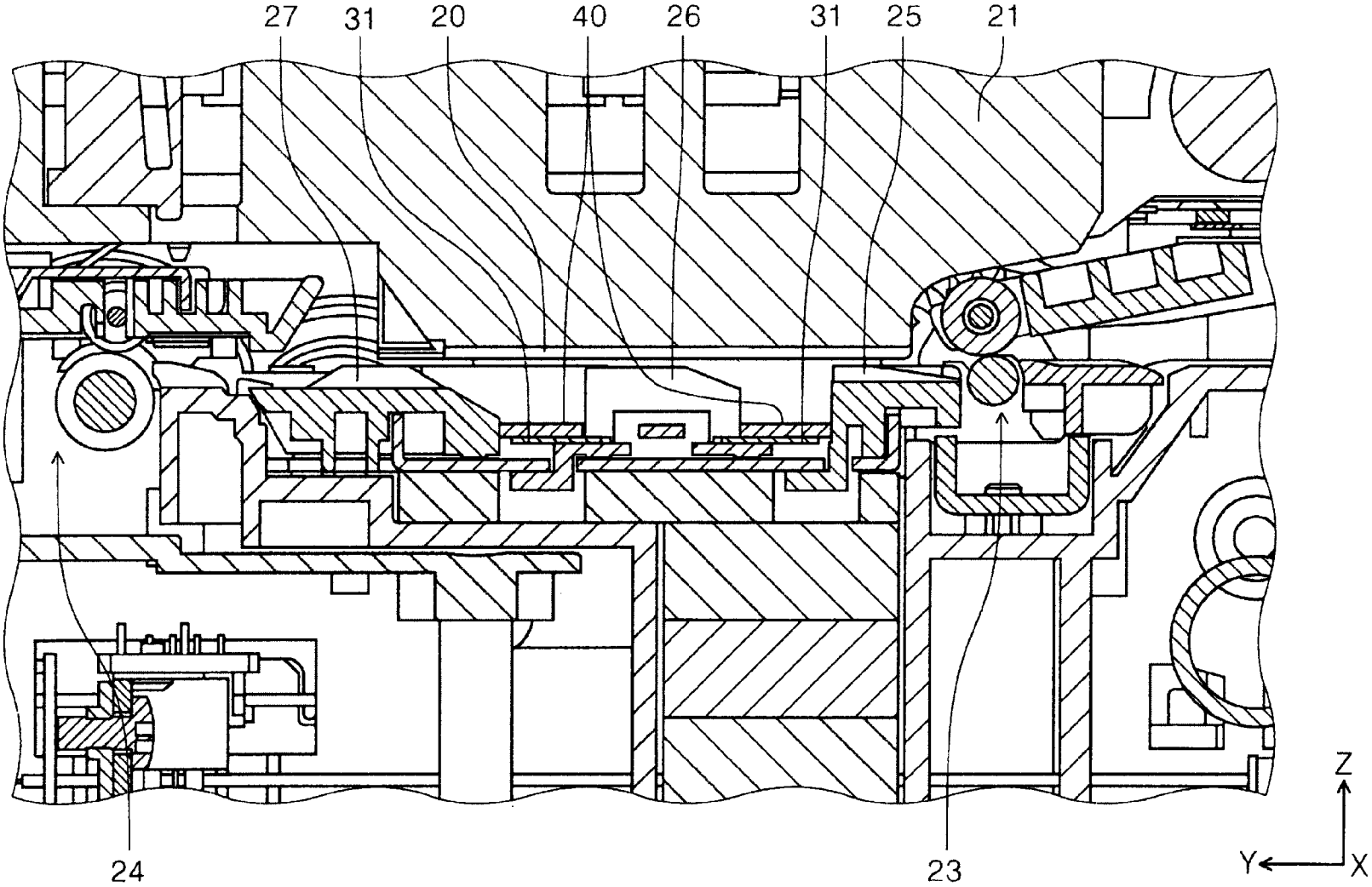
FIG. 5 is a side cross-sectional view of the vicinity of a recording head and a medium supporting portion of the printer.
Figure 6:
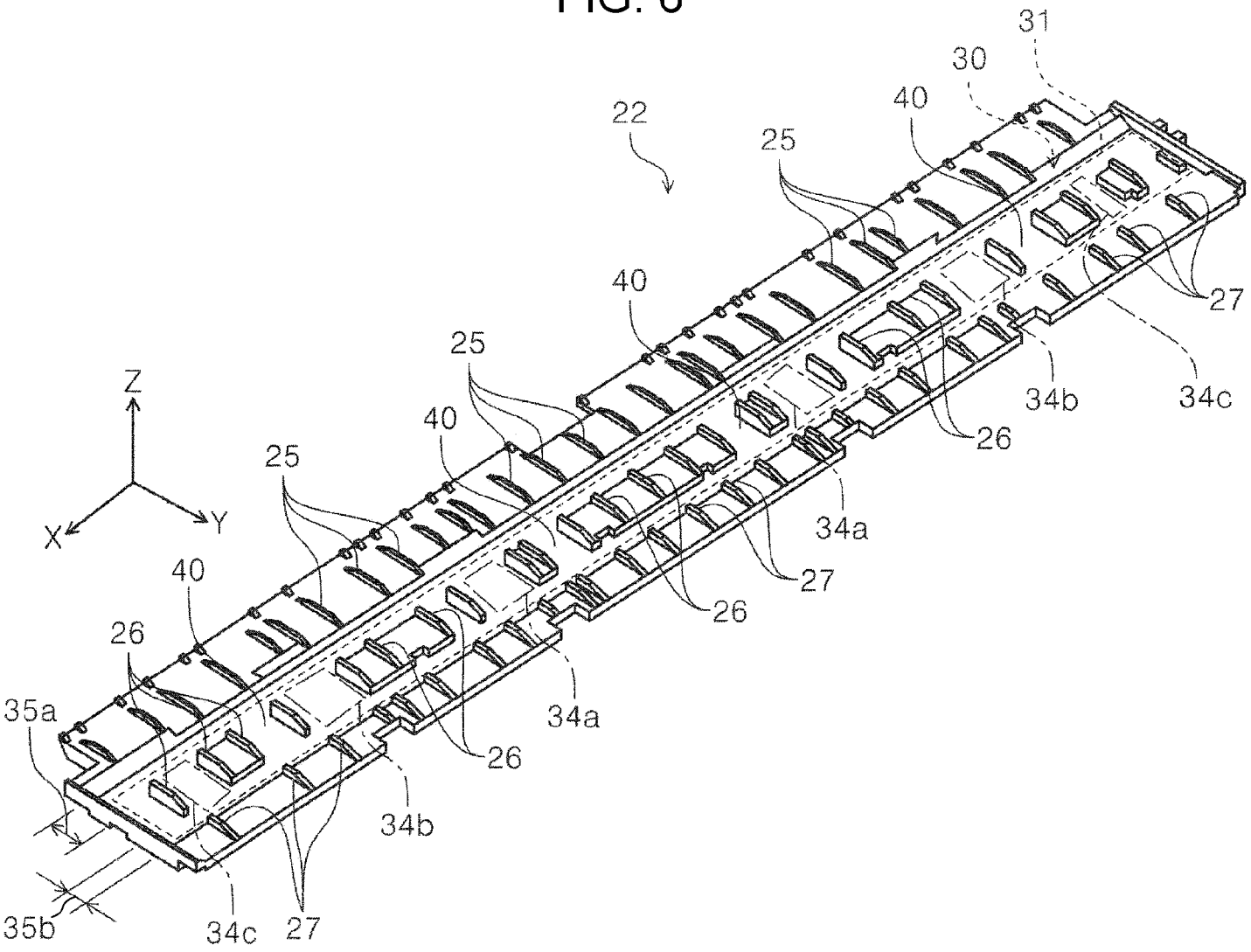
FIG. 6 is a perspective view of the medium supporting portion.
Figure 7:
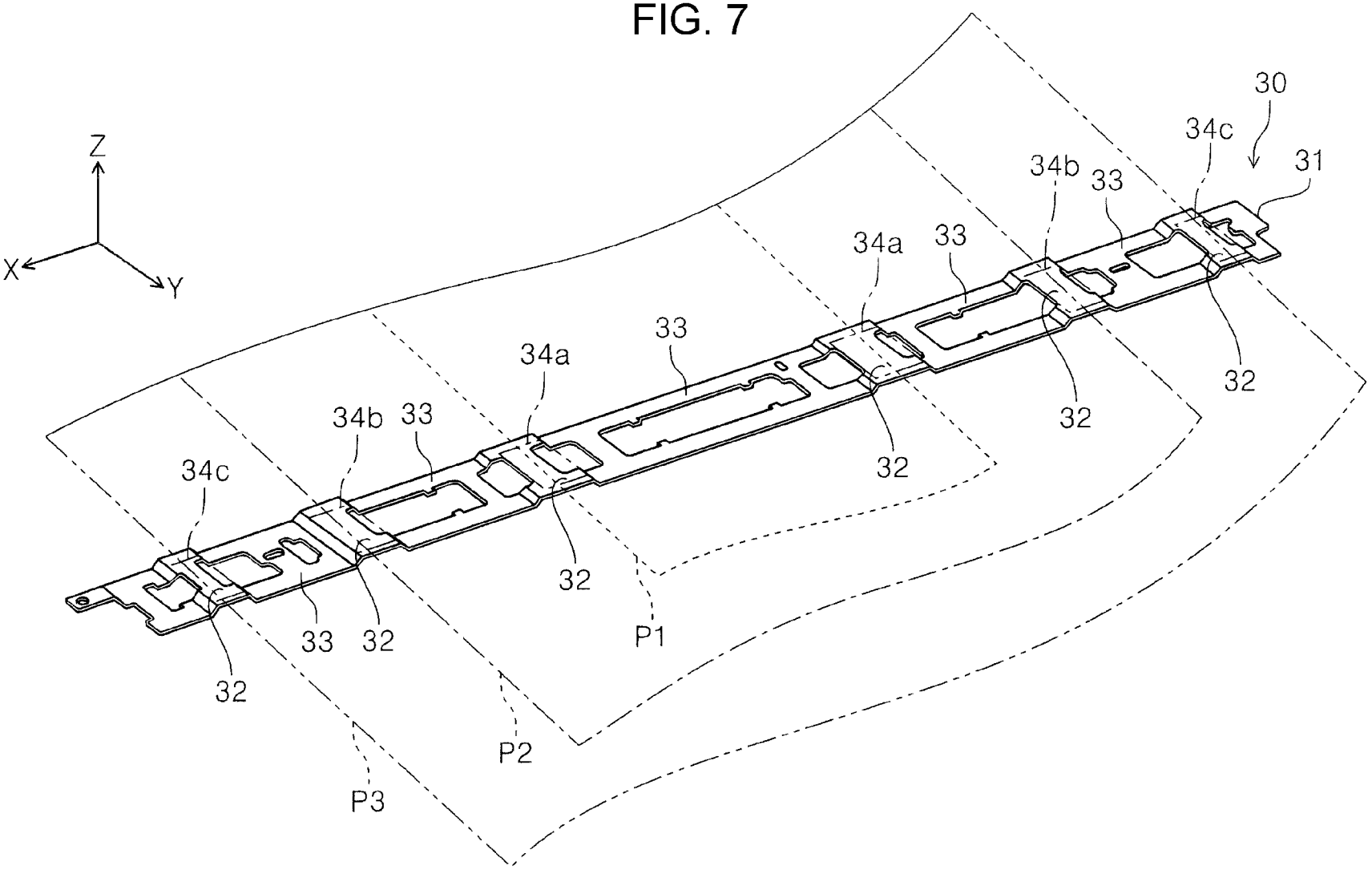
FIG. 7 is a perspective view of a conductive member constituting an electric field forming section of the printer.
Figure 8:
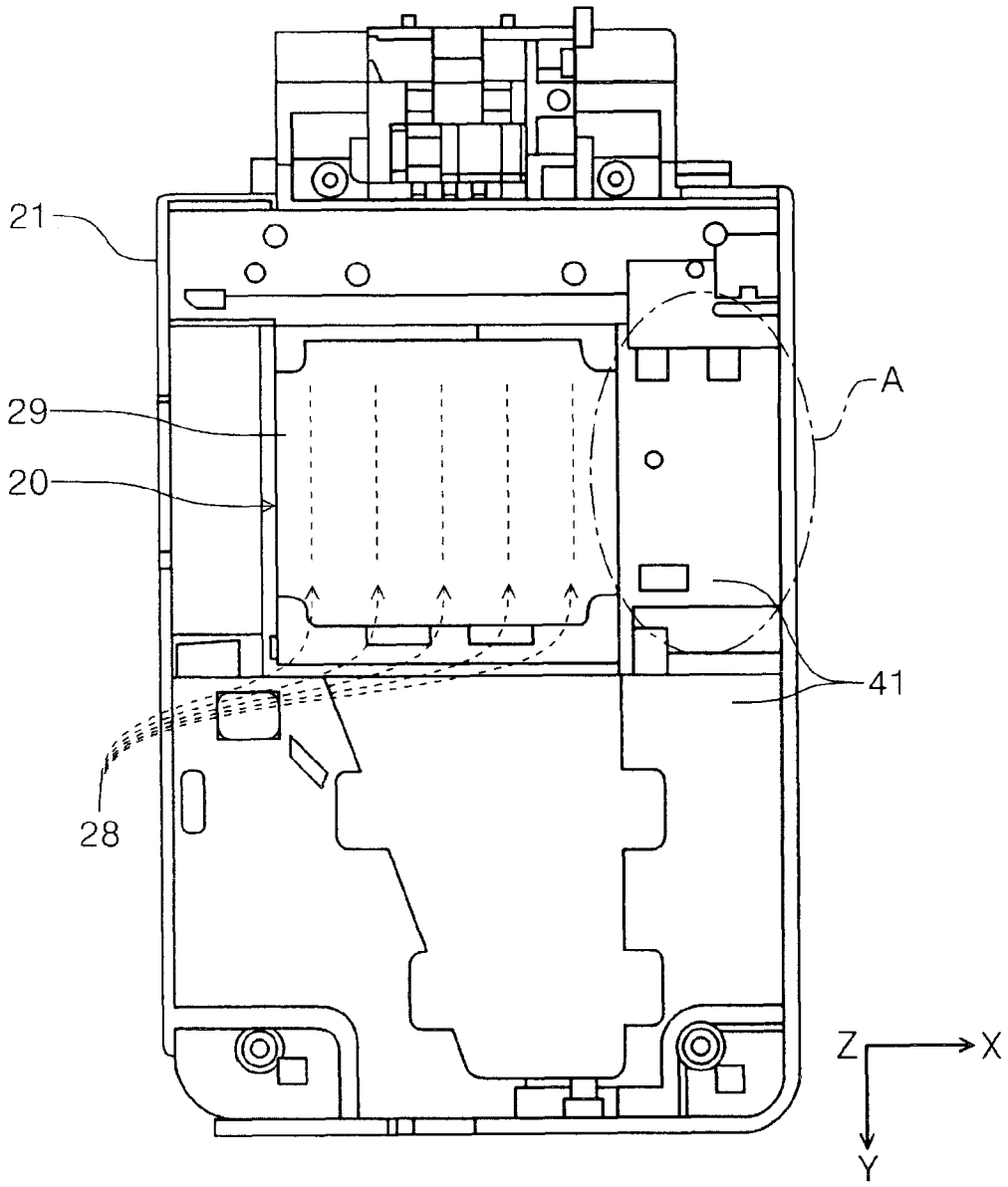
FIG. 8 is a diagram viewed from the side of a bottom face portion of a carriage of the printer.
Figure 9:
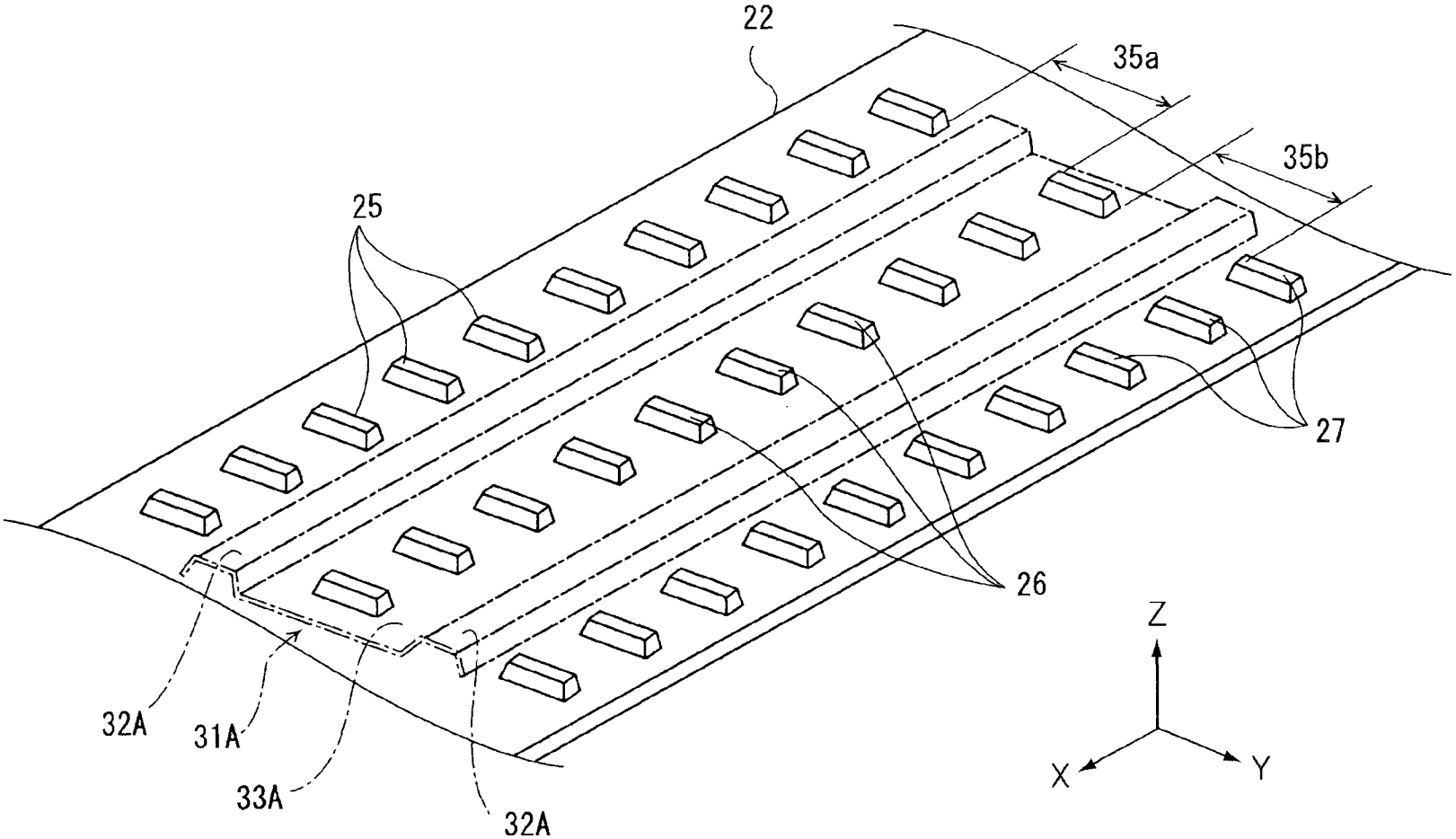
FIG. 9 is a diagram illustrating a modification example of the conductive member.

FIG. 1 is a perspective, external view of the printer 1, according to the present embodiment. FIG. 2 is a diagram illustrating a deployed state of a discharged paper tray in the printer 1, according to the present embodiment. FIG. 3 is a diagram illustrating a paper transport path of the printer 1, according to the present embodiment. FIG. 4 is a perspective view of the printer 1, illustrating a state in which the outer covering of an apparatus body of the printer 1 is removed. FIG. 5 is a side cross-sectional view of the vicinity of a recording head and a medium supporting portion of the printer 1. FIG. 6 is a perspective view of the medium supporting portion. FIG. 7 is a perspective view of a conductive member constituting an electric field forming section of the printer 1. FIG. 8 is a diagram viewed from the side of a bottom face portion of a carriage of the printer 1. FIG. 9 is a diagram illustrating a modification example of the conductive member.

In an X-Y-Z axes coordinate system illustrated in each of the figures, an X-axis direction corresponds to an apparatus width direction, and a Y-axis direction corresponds to an apparatus depth direction. A Z-axis direction corresponds to the direction of gravitational force, and indicates an apparatus height direction. Further, a +Y-axis direction side is defined as an apparatus front side, and a −Y-axis direction side is defined as an apparatus rear side. Further, a left side and a right side viewed from the apparatus front side are respectively defined as a +X-direction side and a −X-axis direction side. Further, a +Z-axis direction side is defined as an apparatus upper side (including an upper portion, an upper face, and the like), and a −Z-axis direction side is defined as an apparatus lower side (including a lower portion, a lower face, and the like). Further, in the following description, in the printer 1, a direction in which paper is transported will be referred to as "downstream", and a direction opposite the direction in which paper is transported will be referred to as "upstream".

Overall Configuration of Printer

Hereinafter, the overall configuration of the printer 1, according to the present embodiment of the invention, will be outlined mainly referring to FIGS. 1 to 3.

The printer 1 illustrated in FIG. 1 is configured to include a recording head 20 (FIG. 3) in the inside of an apparatus body 2. This recording head 20 performs ink jet recording on a sheet of paper as an example of the medium. The recording head 20 includes nozzle rows 28 (FIG. 8). These nozzle rows 28 are rows of nozzles through which ink as an example of the liquid is ejected onto the sheet of paper being transported.

Further, an operation panel 4 is provided on the apparatus front side of the printer 1 of FIG. 1, and this operation panel 4 is configured to include components, such as a power on/off button, operation buttons for various printing settings and the execution of recording, and a display portion for displaying the content of the printing settings, and the like. Further, a front cover 5 is provided on the apparatus front side, and this front cover 5 is openable and closable. The printer 1 is configured such that an operation of opening the front cover 5 allows a discharged paper tray 10 (FIGS. 2 and 3) to be exposed. This discharged paper tray 10 receives the sheet of paper that is paper-fed from a paper feed tray 7 (FIG. 3), which will be described later, and that is discharged from the apparatus body 2 after having been subjected to recording.

The discharged paper tray 10 (FIGS. 2 and 3) is configured to include a first tray 11 and a second tray 12, and the first tray 11 and the second tray 12 are capable of being displaced along a medium discharge direction (the +Y-axis direction). The discharged paper tray 10 is configured to be capable of receiving the sheet of paper that is discharged after having been subjected to recording, in such a way as to allow the whole of the discharged paper tray 10, that is, both of the first tray 11 and the second tray 12, to be brought into a deployed state (FIG. 2) in which the first tray 11 and the second tray 12 are displaced in the medium discharge direction (the +Y-axis direction) from a stowed state (FIG. 1) in which the first tray 11 and the second tray 12 are stowed in the inside of the apparatus body 2. Note that, in this case, the discharged paper tray 10 is also capable of receiving the discharged sheet of paper in a state in which the first tray 11 remains stayed at a position where the first tray 11 is in the stowed state and only the second tray 12 is displaced in the medium discharge direction (the +Y-axis direction).

Further, the paper feed tray 7, illustrated in FIG. 3, is capable of containing a plurality of sheets of paper. The paper feed tray 7 is configured to be attachable and detachable relative to the apparatus body 2. Further, in FIG. 1, a reference sign 6 denotes an openable and closable rear cover that is disposed on the rear and upper side of the apparatus body 2, and the printer 1 is configured such that an operation of opening the rear cover 6 enables feeding of the sheet of paper utilizing a rear paper feed portion 8 (FIG. 3).

Regarding Paper Transport Path of Printer

Next, a paper transport path in the printer 1 will be described mainly referring to FIG. 3. First, the feeding of a sheet of paper from the rear paper feed portion 8 will be described, and thereafter, the feeding of a sheet of paper from the paper feed tray 7 that is provided on the apparatus bottom side will be described. Note that, in FIG. 3, a transport path T1, as a transport path for the sheet of paper fed from the rear paper transport portion 8, is indicated by a long dashed double-short dashed line. Further, a transport path T2, as a transport path for the sheet of paper fed from the paper feed tray 7 up to the upper stream side of pairs of transport rollers 23, is indicated by a dashed line.

The rear paper feed portion 8 includes a setting portion 9, and this setting portion 9 is capable of supporting a plurality of sheets of paper having been set thereon. For the sheets of paper having been set on the setting portion 9, a top-located sheet of paper among the sheets of paper is picked up and fed toward the downstream side by a first feed roller 13. Here, the setting portion 9 is configured as a hopper capable of swinging in such a way as to allow the front edge sides (the downstream sides) of sheets of paper being set on the setting portion 9 to move forward/backward relative to the first feed roller 13 in accordance with the number of the sheets of paper being set on the setting portion 9. Further, the pairs of transport rollers 23 are provided at positions in advance of the first feed roller 13, and thereby, the sheet of paper is fed to a position below the recording head 20. Here, the pairs of transport rollers 23 are rotation-driven by an unillustrated motor.

Subsequently, the recording head 20 is provided on a bottom face portion 41 (FIG. 8), as a bottom face portion of the carriage 21, so as to be exposed, and the carriage 21 is driven by the power of an unillustrated motor so as to reciprocate in the X-axis direction as a scanning direction of the carriage 21. The carriage 21 is guided and moved in the X-axis direction by a guide shaft 19 (also see FIG. 4), and this guide shaft 19 is provided inside a guide frame 18. Further, a medium supporting portion 22, as an example of the "nozzle facing portion", is provided at a position facing a nozzle forming face of the recording head 20, that is, a bottom face of the carriage 21. The recording head 20 performs recording by ejecting ink as the liquid onto a sheet of paper being supported by the medium supporting portion 22.

Note that, in the printer 1 according to the present embodiment, as a "recording unit" for performing recording on a sheet of paper, the carriage 21 and the recording head 20, which is mounted inside the carriage 21 and performs recording by ejecting the ink onto the sheet of paper while reciprocating in a direction intersecting with a paper transport direction, are provided, but the "recording unit" can be also configured to include a line-type recording head in which the nozzles, through which the ink is ejected, are provided in such a way so as to cover the entire width of the sheet of paper.

When the ink is ejected from the recording head 20 to perform the recording on the sheet of paper, electrically-charged ink mist (hereinafter referred to as just "mist" in some cases) is sometimes separated from ink droplets and floats. An electric field forming section 30 is provided on the medium supporting portion 22 side, and this electric field forming section 30 is configured to cause the mist originated from the ink having been ejected from the recording head 20 to be attracted in a direction away from the recording head 20. The electric field forming section 30 includes a conductive member 31 (FIG. 5), and this conductive member 31 is provided on the lower side of the medium supporting portion 22.

A first absorbing member 40 (FIG. 5), as an absorbing member capable of absorbing the ink and the mist, is provided in the medium supporting portion 22, and the mist is absorbed and collected into the first absorbing member 40. In the present embodiment, as illustrated in FIG. 5, the first absorbing member 40 is provided on the upper side of the conductive member 31. Further, the configurations of the electric field forming section 30 and the first absorbing member 40 that are provided in the medium supporting portion 22 will be described later in more detail.

Further, a pair of discharge rollers 24 is provided on the downstream side of the medium supporting portion 22. The pair of discharge rollers is rotation-driven by an unillustrated motor. A sheet of paper having been subjected to the recording by the recording head 20 is discharged toward the above-described discharged paper tray 10 by the pair of discharge rollers 24.

Further, a plurality of sheets of paper P is contained in the paper feed tray 7, and the printer 1 is capable of feeding the sheets of paper on a sheet-by-sheet basis from the paper feed tray 7 as well. The paper feed tray 7 is provided in such a way as to be capable of being caused to slide between a feedable position (FIG. 3) and a retracted position (not illustrated), as a position displaced from the feedable position to the apparatus front side (in the +Y-axis direction in FIG. 3, that is, in a direction in which the paper feed tray 7 is drawn out).

In FIG. 3, a second feed roller 14 is secured to a roller support member 15, and this roller support member 15 swings about a pivot shaft 15*a*. The second paper feed roller 14 is configured such that, when the paper feed tray 7 is located at a butting position at which the paper feed tray 7 having been caused to slide butts a portion located on the most apparatus rear side (in the −Y-axis direction in FIG. 3, that is, the side of a direction in which the paper feed tray 7 is mounted, and also the side of a direction in which a sheet of paper is fed), the second paper feed roller 14 is allowed to rotate in contact with a top-located sheet of paper among sheets of paper P been contained in the paper feed tray 7, and thereby feeds the top-located sheet of paper from the paper feed tray 7. The sheet of paper P having been fed by the second paper feed roller 14 is fed upward along an inclined face 17. This inclined face 17 forms a transport path face.

Further, an intermediate roller 16 is provided on the downstream side of the second paper feed roller 14 and the inclined face 17. This intermediate roller 16 is rotation-driven by an unillustrated motor. The sheet of paper is curved and reversed by the intermediate roller 16, and is fed toward the apparatus front side.

The sheet of paper having been fed along the transport path T2, which is indicated by a dashed line, enters the transport path T1 (indicated by a long dashed double-short dashed line) that joins the transport path T2 at a position just before the pairs of transport rollers 23. Further, in a following downstream side portion, like a sheet of paper having been fed from the rear paper feed portion 8, the relevant sheet of paper is transported by the pairs of transport rollers 23, and is subjected to the recording by the recording head 20. Thereafter, the relevant sheet of paper is discharged toward the discharged paper tray 10 by the pair of discharge rollers 24.

Further, when recording on both faces of the sheet of paper is performed, after the completion of recording on its adverse face by the recording head 20, the sheet of paper is switched back, that is, the sheet of paper is caused to enter the transport path T2 from a portion below the intermediate roller 16 and to be curved and reversed, thereby enabling recording on the reverse face of the sheet of paper to be performed.

Regarding Medium Supporting Portion and First Absorbing Member

Next, the medium supporting portion 22 and the first absorbing member 40 will be described. As illustrated in FIGS. 5 and 6, in the medium supporting portion 22, a plurality of first ribs 25 is provided. These first ribs 25 are disposed at intervals in a width direction (the X-axis direction) intersecting with the transport direction of the sheet of paper. Further, a plurality of second ribs 26 is provided on the downstream side of the individual first ribs 25. These second ribs 26 are also disposed at intervals in the width direction just like the first ribs 25. Moreover, a plurality of third ribs 27 is provided on the downstream side of the individual second ribs 26. These third ribs 27 are disposed at intervals in the width direction. The sheet of paper being transported is supported from its lower side by the first ribs 25, the second ribs 26, and the third ribs 27.

Further, the first absorbing member 40 is disposed in the medium supporting portion 22. The first absorbing member 40 is provided so as to cover at least ink discarding regions each of which, in the execution of the borderless recording for ejecting the ink onto both of the inside and the outside of each of edges of the sheet of paper, is used for discarding the ink ejected onto the outside of a corresponding one of the edges whose positions correspond to each of sizes of the sheet of paper, and the relevant first absorbing member 40 absorbs the discarded ink.

In the transport direction of the sheet of paper, that is, in the Y-axis direction, as illustrated in FIG. 6, a region between the first ribs 25 and the second ribs 26 corresponds to an ink discarding region 35*a*, and a region between the second ribs 26 and the third ribs 27 corresponds to an ink discarding region 35*b*. Here, the ink discarding region 35*a* is used for discarding the ink ejected onto the outside of the transport-direction rear-side edge of the sheet of paper, and the ink discarding region 35*b* is used for discarding the ink ejected onto the outside of the transport-direction front-side edge of the sheet of paper.

Further, ink discarding regions in the paper width direction correspond to regions denoted by reference signs 34*a* and 34*a*, regions denoted by reference signs 34*b* and 34*b*, and regions denoted by reference signs 34*c* and 34*c* in FIG. 6. A set of the ink discarding regions 34*a* and 34*a*, a set of the ink discarding regions 34*b* and 34*b*, and a set of the ink discarding regions 34*c* and 34*c* are each associated with the positions of both width-direction side edges of a corresponding one of three kinds of sheets of paper (sheets of paper P1 to P3 described later, see FIG. 7) having mutually different predetermined width sizes.

The first absorbing member 40 is formed of, for example, a porous substance constituted of a non-woven fabric or a polymer material, or the like. The ink discarded at the time of the execution of the borderless recording is absorbed by the first absorbing member 40.

Regarding Electric Field Forming Section

As described above, the electric field forming section 30 is provided on the side of the medium supporting portion 22 (FIGS. 5 and 6) facing the recording head 20. The electric field forming section 30 is configured to include a conductive member 31. As illustrated in FIG. 5, the conductive member 31 is provided in a lower portion of the medium supporting portion 22, and is disposed at a position interposing the first absorbing member 40 between the medium supporting portion 22 and the conductive member 31 itself.

The electric field forming section 30 is configured to, upon supply of a predetermined voltage to the conductive member 31, form an electric field between the conductive member 31 and the recording head 20 and thereby attract the mist toward the conductive member 31 side. The mist having been attracted to the conductive member 31 side can be collected by allowing the first absorbing members 40 to absorb the mist.

Here, the conductive member 31 (FIG. 7) includes first portions 32 and a second portion 33. The first portions 32 are formed as convex portions, and the second portion 33 is formed as a concaves portion. The first portions 32 further protrude to the +Z-axis direction side than the second portion 33, and thus, the first portions 32 are located nearer the recording head 20 than the second portion 33. That is, the conductive member 31 includes the first portions 32 located near the recording head 20, and the second portion 33 located further away from the recording head 20 than the first portions 32.

Further, the first portions 32 are configured to, in the execution of the borderless recording for ejecting the ink onto both of the inside and the outside of each of edges of the sheet of paper, in other words, in the execution of the borderless recording for performing marginless recording on the sheet of paper, be each disposed at a position included in a corresponding one of the ink discarding regions (whose reference signs being 34*a*, 34*b*, and 34*c* in FIGS. 6 and 7), whose positions correspond to each of the mutually different predetermined width sizes of the three kinds of sheets of paper, and the second portion 33 is disposed in a region other than the ink discarding regions 34*a*, 34*b*, and 34*c*.

In the present embodiment, the set of the ink discarding regions 34*a* and 34*a* is a set of width-direction (X-axis direction) ink discarding regions associated with the sheet of paper P1 (FIG. 7); the set of the ink discarding regions 34*b* and 34*b* is a set of width-direction (X-axis direction) ink discarding regions associated with the sheet of paper P2 (FIG. 7); and the set of the ink discarding regions 34*c* and 34*c* is a set of width-direction (X-axis direction) ink discarding regions associated with the sheet of paper P3 (FIG.

7). Here, the sheet of paper P2 is wider than the sheet of paper P1, and the sheet of paper P3 is wider than the sheet of paper P2.

When the conductive member 31 includes the first portions 32, and the second portion 33, which is located further away from the recording head 20 than the first portions 32, for each of the first portions 32 near the recording head 20, a stronger electric field is generated between the recording head 20 and the each first portion 32, and for the second portion 33, an electric field weaker than that for the each first portion 32 is generated between the recording head 20 and the each second portion 33. That is, two kinds of electric fields having mutually different strengths can be respectively generated for the each first portion 32 and the second portion 33 by applying a constant voltage to the conductive member 31. The voltage applied to the conductive member 31 is constant, and thus, this configuration eliminates the risk that an electric field influencing the positions of the landing of ink droplets onto the sheet of paper is generated at the boundary between the each first portion 32 and second portion 33.

Further, one of the first portions 32, for each of which a stronger electric field is generated between the recording head 20 and the each of the first portions 32, is disposed at a position included in each of the ink discarding regions 34*a*, 34*b*, and 34*c* in which the mist is likely to arise at the time of the execution of the borderless recording, and thus, this configuration brings about a high mist attraction effect in each of the ink discarding regions 34*a*, 34*b*, and 34*c*. Further, in the region other than the ink discarding regions 34*a*, 34*b*, and 34*c*, the second portion 33, for which an electric field weaker than that for each of the first portions 32 is generated between the recording head 20 and the second portions 33, is disposed, and thus, this configuration reduces the risk that ink droplets for use in recording on the sheet of paper are strongly attracted toward the conductive member 31 side, and thereby the quality of recorded images is degraded.

Modification Example of Conductive Member

Hereinafter, a conductive member 31A, as a modification example of the conductive member 31, will be described with reference to FIG. 9.

The conductive member 31A includes first portions 32A and a second portion 33A, and each of the first portions 32A is formed as a convex portion so as to be nearer the recording head 20 than the second portion 33A. Further, the conductive member 31A is configured such that the first portions 32A are respectively disposed at a position corresponding to an ink discarding region 35*a* for the rear edge of a sheet of paper and a position corresponding to an ink discarding region 35*b* for the front edge of the sheet of paper in the paper transport direction (the Y-axis direction). This configuration brings about a high mist attraction effect in the ink discarding regions 35*a* and 35*b*.

In addition to the conductive member 31A, a conductive member configured such that the above first portions are disposed at positions corresponding to both of the ink discarding regions 34*a*, 34*b*, and 34*c* in the paper width direction and the ink discarding regions 35*a* and 35*b* in the paper transport direction can be also used.

Second Embodiment

Figure 10:
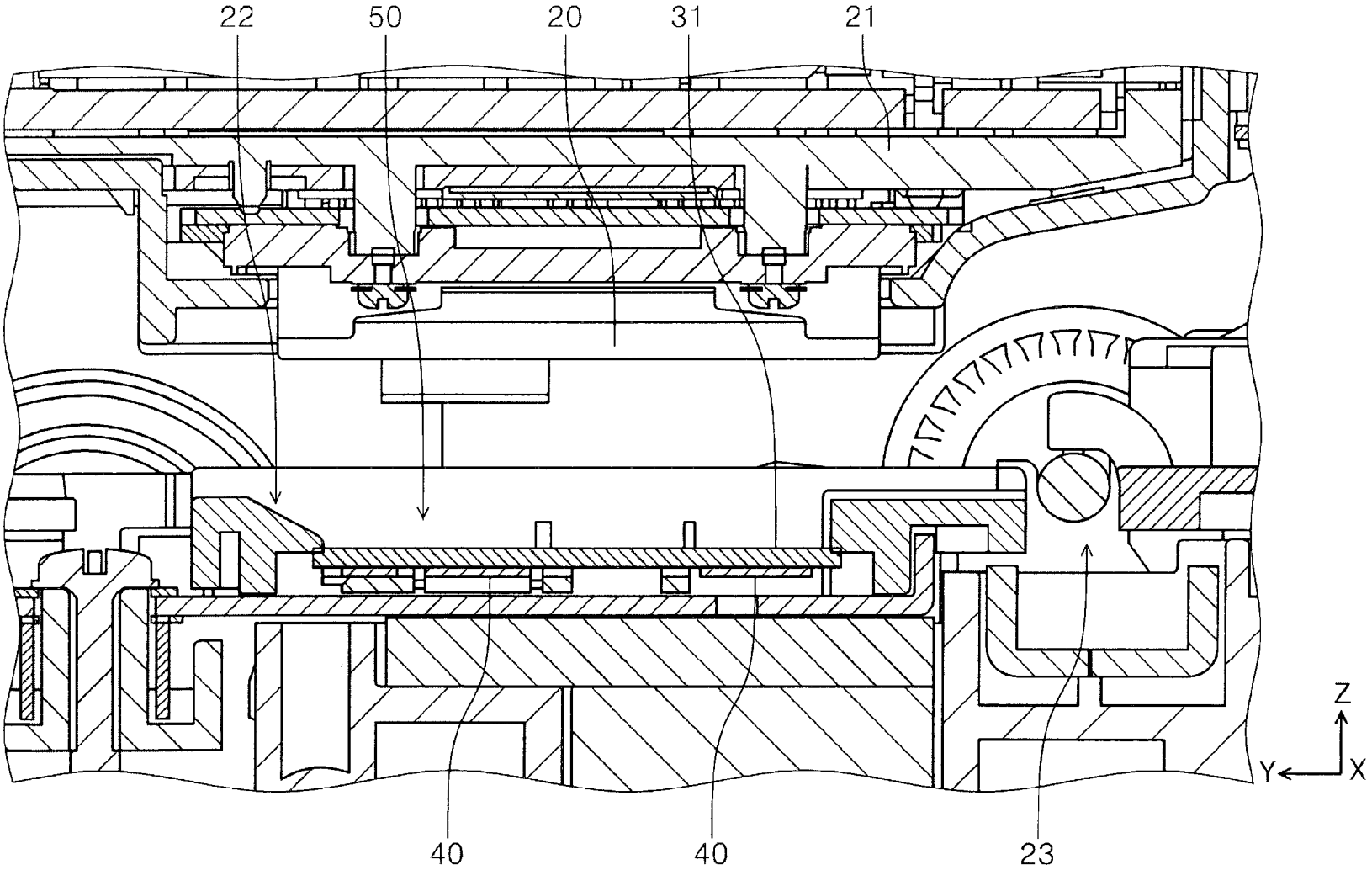
FIG. 10 is a diagram illustrating an electric field forming section according to a second embodiment of the invention.

In this second embodiment, another example of the electric field forming section according to the invention will be described on the basis of FIG. 10. FIG. 10 is a diagram illustrating an electric field forming section according to this second embodiment. Note that, in the present embodiment and a subsequent embodiment, the same components as the components of the first embodiment will be denoted by the same reference signs as those of the components of the first embodiment, and thereby will be omitted from description.

Although, in the first embodiment, the first absorbing member 40 is provided on the upper side of the conductive member 31 (constituting the electric field forming section 30), in this second embodiment, as illustrated in FIG. 10, a conductive member 31, as a conductive member constituting an electric field forming section 50, is provided between the first absorbing member 40 and the recording head 20. That is, in this second embodiment, the electric field member 31 is provided on the upper side of the first absorbing member 40. Note that, in FIG. 10, the conductive member 31 covers the first absorbing member 40, but is provided in such a way that the first absorbing member 40 is exposed in at least one portion of the conductive member 31.

When the first absorbing member 40 is formed of a non-woven fabric or a woven fabric made of fibers, there is a risk that fluff of fibers may be generated on the surface of the first absorbing member 40, and ink having been absorbed by the first absorbing member 40 may travel along the fluff and may be adhered onto a sheet of paper. In the case where, like the configuration of the present embodiment, the conductive member 31 is provided between the first absorbing member 40 and the recording head 20, the first absorbing member 40 is partially covered by the conductive member 31 and its portions exposed from the conductive member 31 are also away from a transported sheet of paper by a distance equivalent to the width of the conductive member 31. This configuration, therefore, minimizes the phenomenon in which the ink having been absorbed by the first absorbing member 40 travels along the fluff, and is adhered onto the sheet of paper.

Third Embodiment

Figure 11:
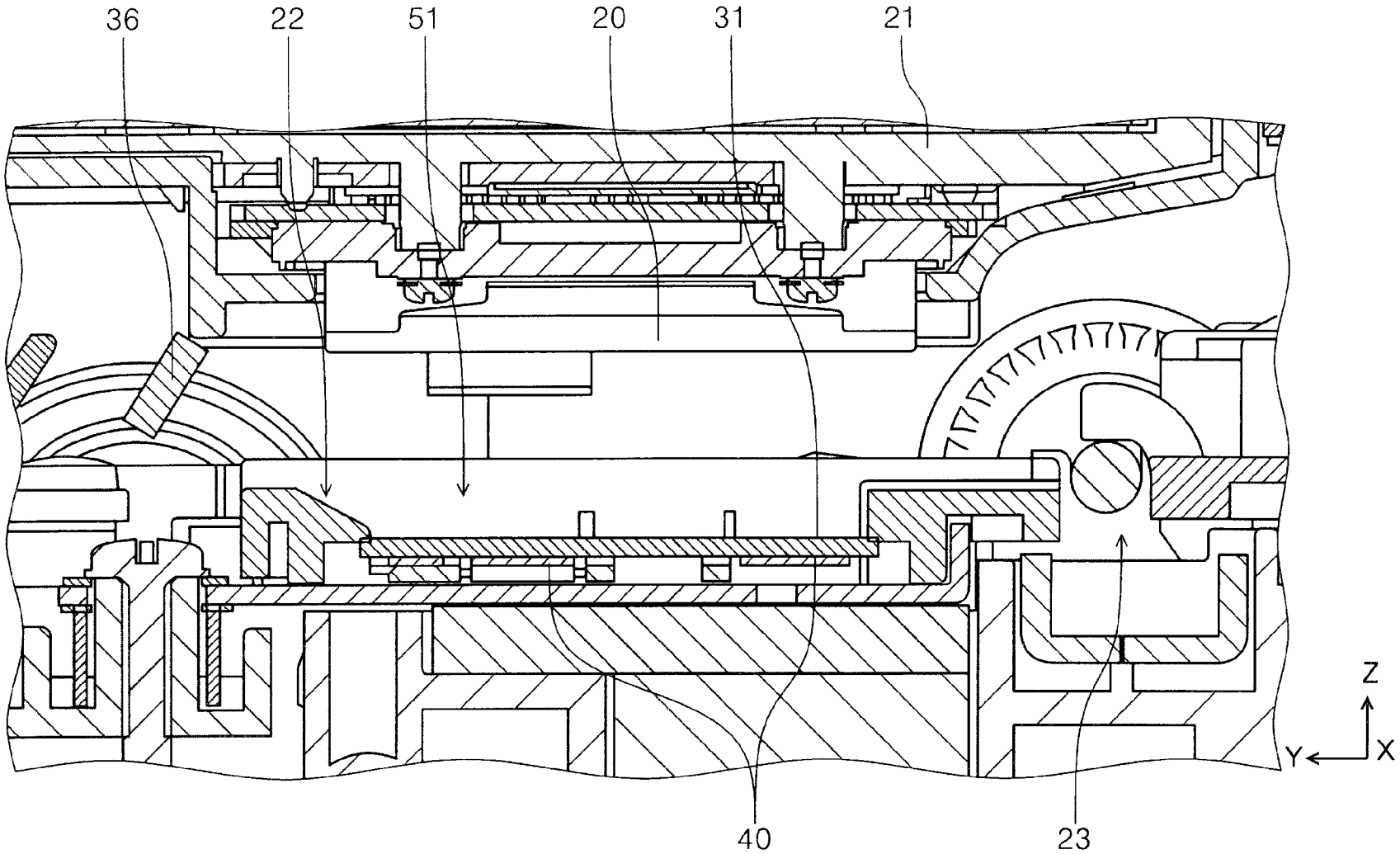
FIG. 11 is a diagram illustrating an electric field forming section according to a third embodiment of the invention.

In this third embodiment, still another example of the electric field forming section according to the invention will be described on the basis of FIG. 11. FIG. 11 is a diagram illustrating an electric field forming section according to this third embodiment. The feature of an electric field forming section 51, as an electric field forming section according to this third embodiment, is that the electric field forming section 51 includes a second conductive member 36.

In the present embodiment, the second conductive member 36 is provided between the recording head 20 and the conductive member 31 in a height direction (in the Z-axis direction). Further, the second conductive member 36 is provided so as to extend across a reciprocation region of the carriage 21 in the apparatus width direction (in the X-axis direction).

In the case where an electric potential difference is formed between the conductive member 31 and the recording head 20 by applying a voltage to the conductive member 31, when, for example, the conductive member 31 is positively charged, the recording head 20 side is negatively charged. When the electric field difference between the conductive member 31 and the recording head 20 is large, the negative charge of the recording head 20 side becomes strong.

Here, in the case where an electric potential difference is formed between the conductive member 31 and the recording head 20 by applying a voltage to the conductive member 31, for example, in the configuration in which the conductive member 31 is positively charged, because of electrostatic induction due to the conductive member 31 having been positively charged, for ink droplets having been ejected from the recording head 20, leading-end ink droplets being among the ink droplets and located on a side near the conductive member 31 induce negative charges; while rear-end ink droplets being among the ink droplets and located on a side opposite the above side, that is, on a side near the recording head 20, induce positive charges. Accordingly, when the rear-end ink droplets among the ink droplets having been ejected from the recording head 20 are separated and become satellite liquid droplets, since these satellite liquid droplets are positively charged, the satellite liquid droplets are repelled and attracted respectively by the positively charged electrode plate and the negatively charged recording head 20, and consequently are caused to move to a nozzle forming face 29, as a nozzle forming face of the recording head 20. Further, the satellite liquid droplets are adhered to the nozzle openings of the nozzle arrows 28, and this adhesion of the satellite liquid droplets to the nozzle openings may become a cause of defective nozzles.

In the case where, like the configuration of the present embodiment, the second conductive member 36 is provided between the recording head 20 and the conductive member 31, when a voltage is applied to the conductive member 31 to allow the conductive member 31 to be positively charged, an electric field is generated between the conductive member 31 and the second conductive member 36, and the second conductive member 36 is negatively charged. With this configuration, the above positively-charged satellite liquid droplets are attracted to the second conductive member 36, the risk that the above satellite liquid droplets are adhered onto the recording head 20 is reduced. Accordingly, the occurrence of the defective nozzles in the nozzle rows 28 of the recording head 20 is minimized or eliminated. Note that, in addition to the above configuration illustrated in FIG. 11, in which the second conductive member 36 is provided on the downstream side relative to the recording head 20 in the paper transport direction, another configuration in which the second conductive member 36 is provided on the upstream side of the recording head 20 is applicable. Further, still another configuration in which the second conductive member 36 is provided on each of the upstream side and the downstream side of the recording head 20 is also applicable.

Other Configurations in Printer

Regarding Second Absorbing member

Figure 14:
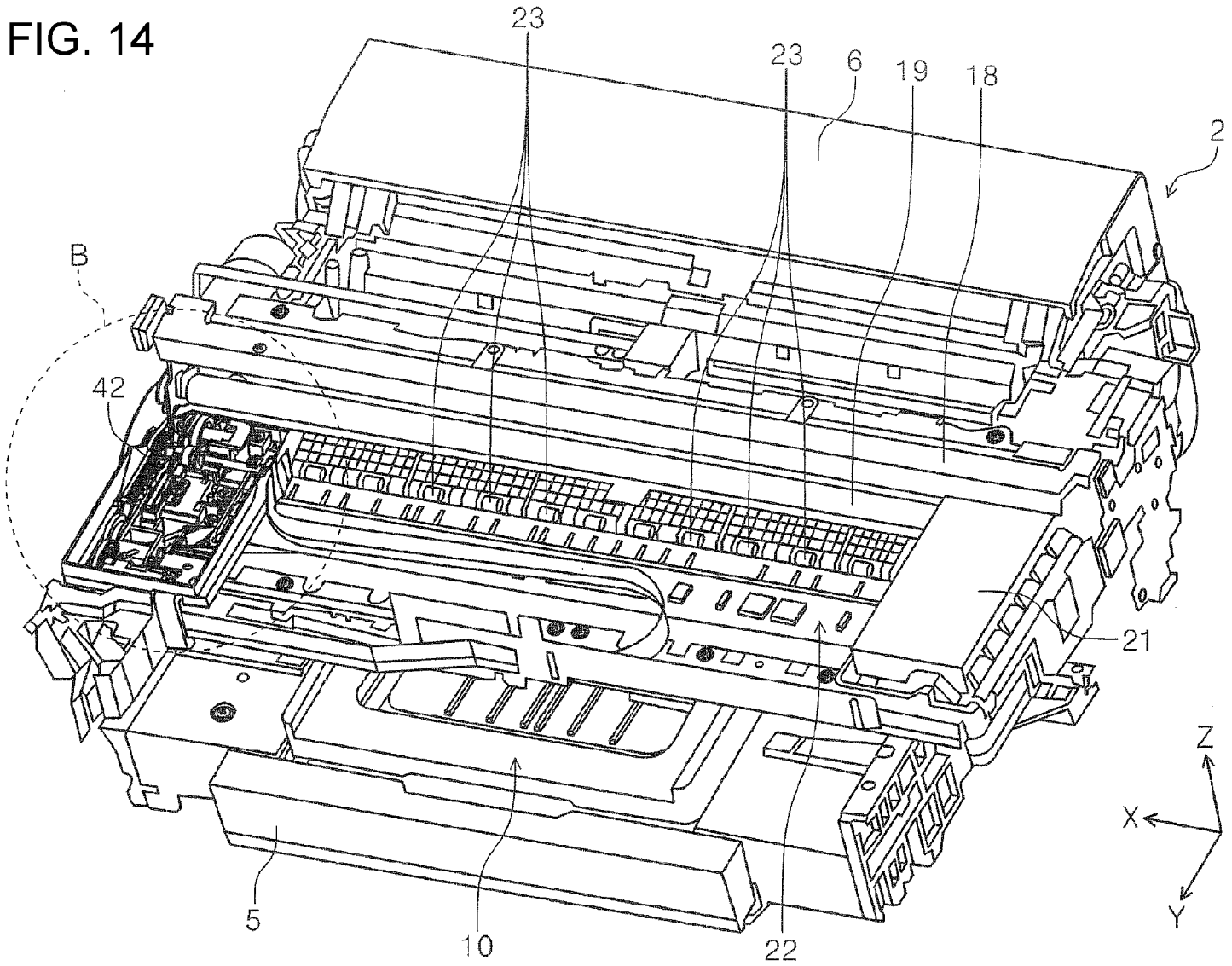
FIG. 14 is a perspective view of the apparatus body, illustrating a position where a second absorbing member is disposed.
Figure 15:
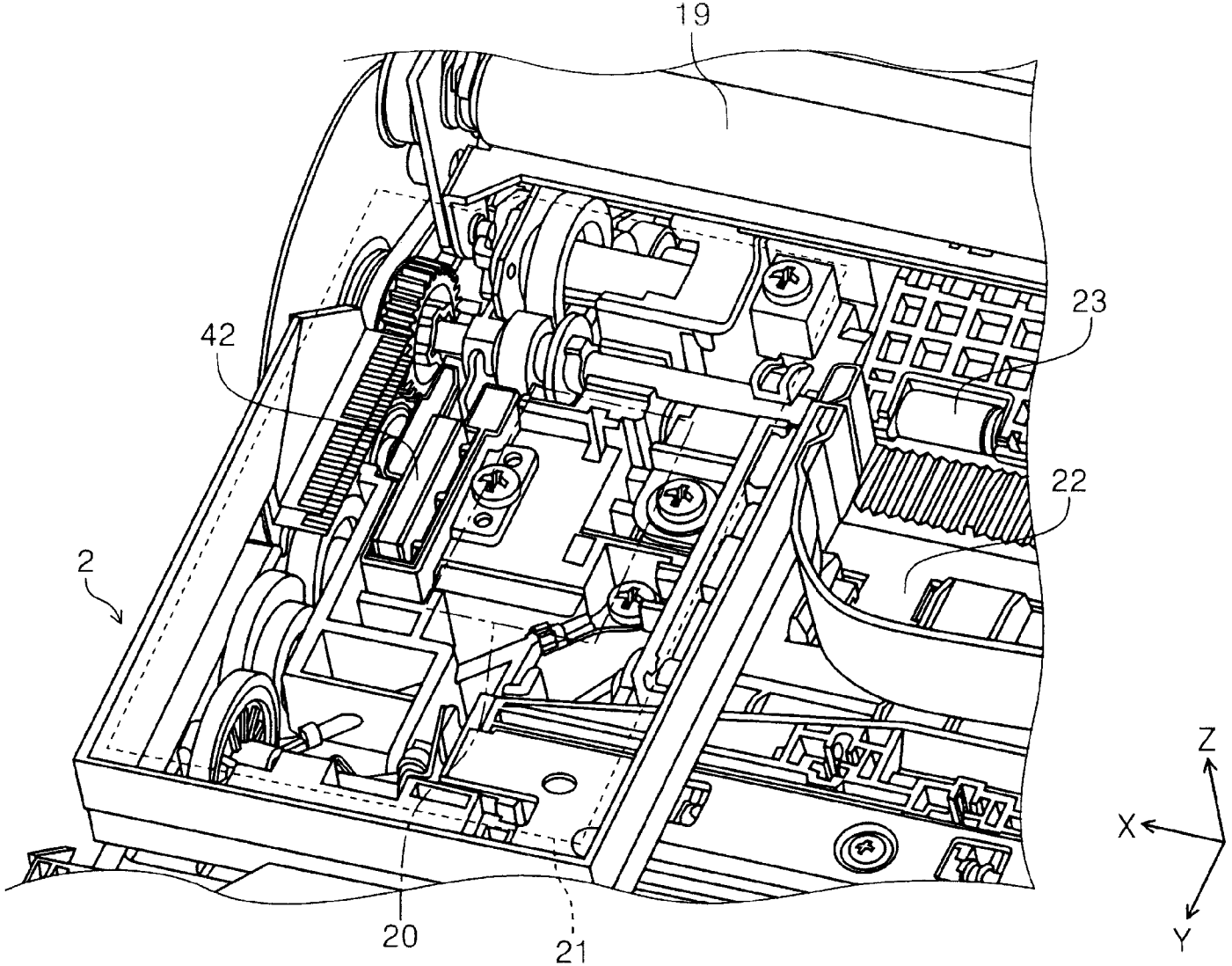
FIG. 15 is an enlarged view of a portion XV of FIG. 14.
Figure 16:
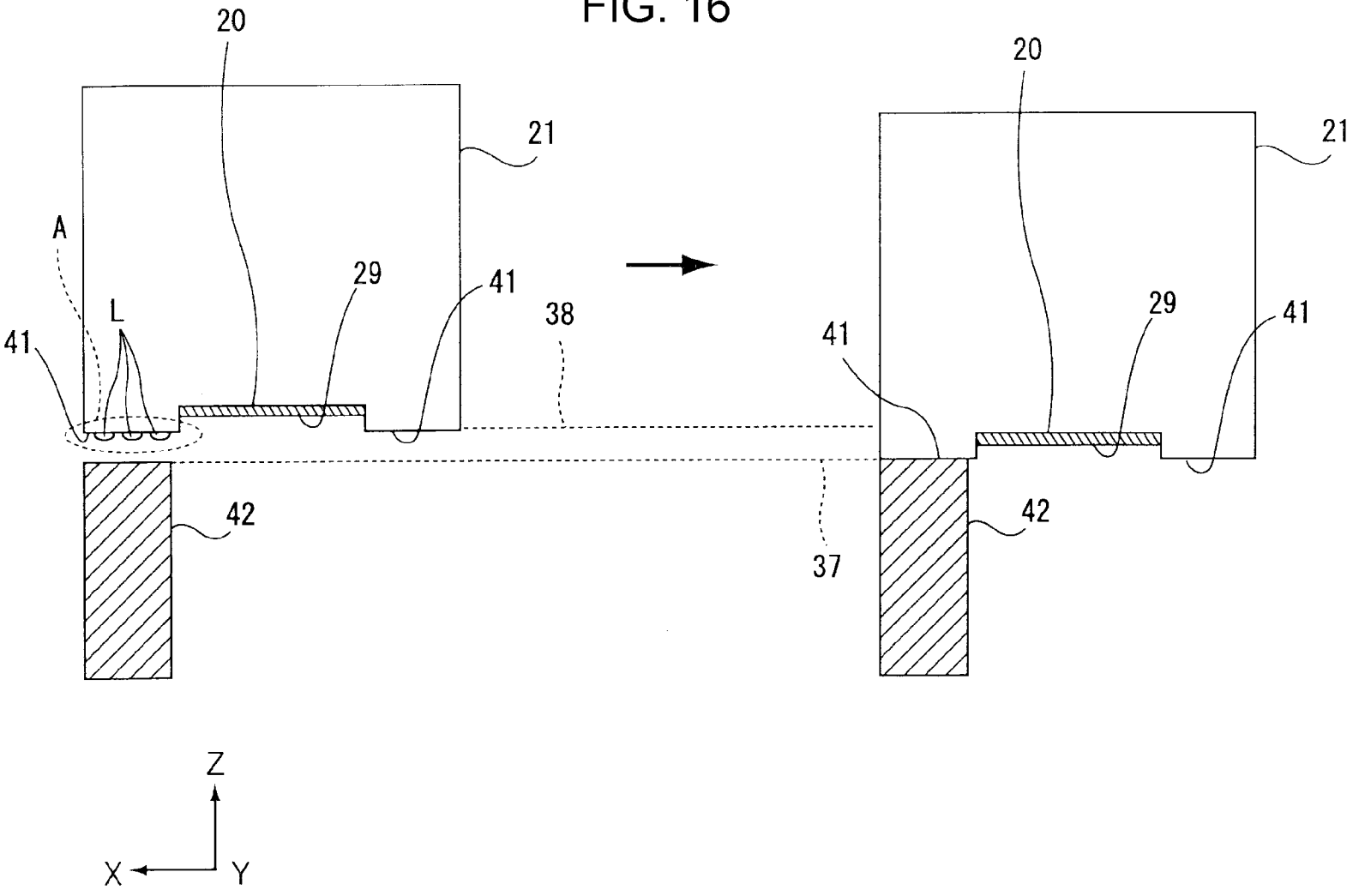
FIG. 16 is a diagram illustrating an advanced state and a retracted state of the carriage.

A second absorbing member 42 will be described with reference to FIGS. 14 to 16. FIG. 14 is a perspective view of the apparatus body 2, illustrating a position where the second absorbing member 42 is disposed. FIG. 15 is an enlarged view of a portion XV of FIG. 14. FIG. 16 is a diagram illustrating an advanced state and a retracted state of the carriage 21.

The second absorbing member 42 (FIGS. 14 and 15) is provided within a reciprocation region of the carriage 21. The second absorbing member 42 is capable of absorbing the ink. The second absorbing member 42 is a material for absorbing mists having been adhered on the bottom face portion 41 of the carriage 21 or liquid resulting from the accumulation of the mists.

In FIG. 14, a position where the carriage 21 is located corresponds to one end portion on the −X-axis direction side of the reciprocation region of the carriage 21, and is a home position of the carriage 21. The second absorbing member 42 is disposed on the other end side located opposite the home position (namely, on the +X-axis direction side). Here, in FIG. 15, the position of the carriage 21 at the time when the carriage 21 is located in a +X-axis direction side end portion of the reciprocation region of the carriage 21 is represented by a dashed line. Further, the position of the recording head 20 at this time is represented by a long dashed short dashed line.

The carriage 21 is configured to be capable of being displaced in a direction in which the carriage 21 advances/retracts relative to the medium supporting portion 22, that is, in the Z-axis direction. Further, the carriage 21 is configured to be capable of having an advanced state (a right-side figure of FIG. 16) in which at least one portion of the bottom face portion 41 of the carriage 21 is in contact with the second absorbing member 42, and a retracted state (a left-side figure of FIG. 16) in which the carriage 21 is retracted from the advanced state and is away from the second absorbing member 42. Here, a position denoted by a reference sign 37 in the right-side figure of FIG. 16 is a height position of the bottom face portion 41 in the advanced state of the carriage 21, and a position denoted by a reference sign 38 in the left-side figure of FIG. 16 is a height position of the bottom face portion 41 in the retracted state of the carriage 21. At the time of the execution of the recording, the carriage 21 has the retracted state (the left-side figure of FIG. 16), and even when the carriage 21 reciprocates in the X-axis direction, the bottom face portion 41 does not contact the second absorbing member 42.

Here, when a plurality of passes for the reciprocation of carriage 21 are carried out at the time of the execution of the recording, mist that is not absorbed by the first absorbing member 40 and is floating is likely to be adhered onto the bottom face portion 41 of the carriage 21. The adhered mist gathers and forms liquid droplets (denoted by a reference sign L in the left-side figure of FIG. 16), and the liquid droplets L sometimes drip down and soil the sheet of paper.

In order to eliminate such a defect, for example, every time the carriage 21 reciprocates by a predetermined total pass execution number, the carriage 21 is brought into the advanced state (the right-side figure of FIG. 16) in the end portion on the +X-axis direction side of the reciprocation region of the carriage 21. This configuration allows the second absorbing member 42 to absorb the liquid droplets L originated from the mist having been adhered onto the bottom face portion 41 of the carriage 21, and thereby minimizes or eliminates the dripping of the liquid droplets L onto the sheet of paper.

In the present embodiment, the second absorbing member 42 is brought into contact with the portion A (see FIG. 8, in addition to FIG. 16) located further toward the other end side than the nozzle forming face 29 (namely, on the +X-axis direction side opposite the home position) in the bottom face portion 41 of the carriage 21 being in the advanced state. In this way, the configuration that allows the second absorbing member 42 to absorb the liquid droplets L originated from the mist having been adhered onto the portion A is achieved. Note that a configuration in which a −X-axis direction portion of the nozzle forming face 29 is wiped off at the home position at the time of the execution of wiping of the nozzle forming face 29 is applicable. Naturally, a configuration in which another second absorbing member 42 is provided on the home position side, and the carriage 21 is brought into the advanced state at the home position to allow the second absorbing member 42 to absorb liquid droplets having been adhered onto the −X-axis direction portion of the nozzle forming face 29 is also applicable.

Other Configurations of Carriage

As described above, mist is likely to be adhered onto the bottom face portion 41 of the carriage 21, gather, and form liquid droplets. In this regard, configurations that make it hard for the liquid droplets resulting from the adhesion of the mist to drip down can be applied to the bottom face portion 41. In the following, two examples of a section for suppressing the dripping of the liquid droplets (hereinafter referred to as a liquid dripping suppression section) will be described.

Example 1 of Liquid Dripping Suppression Section

Figure 12:
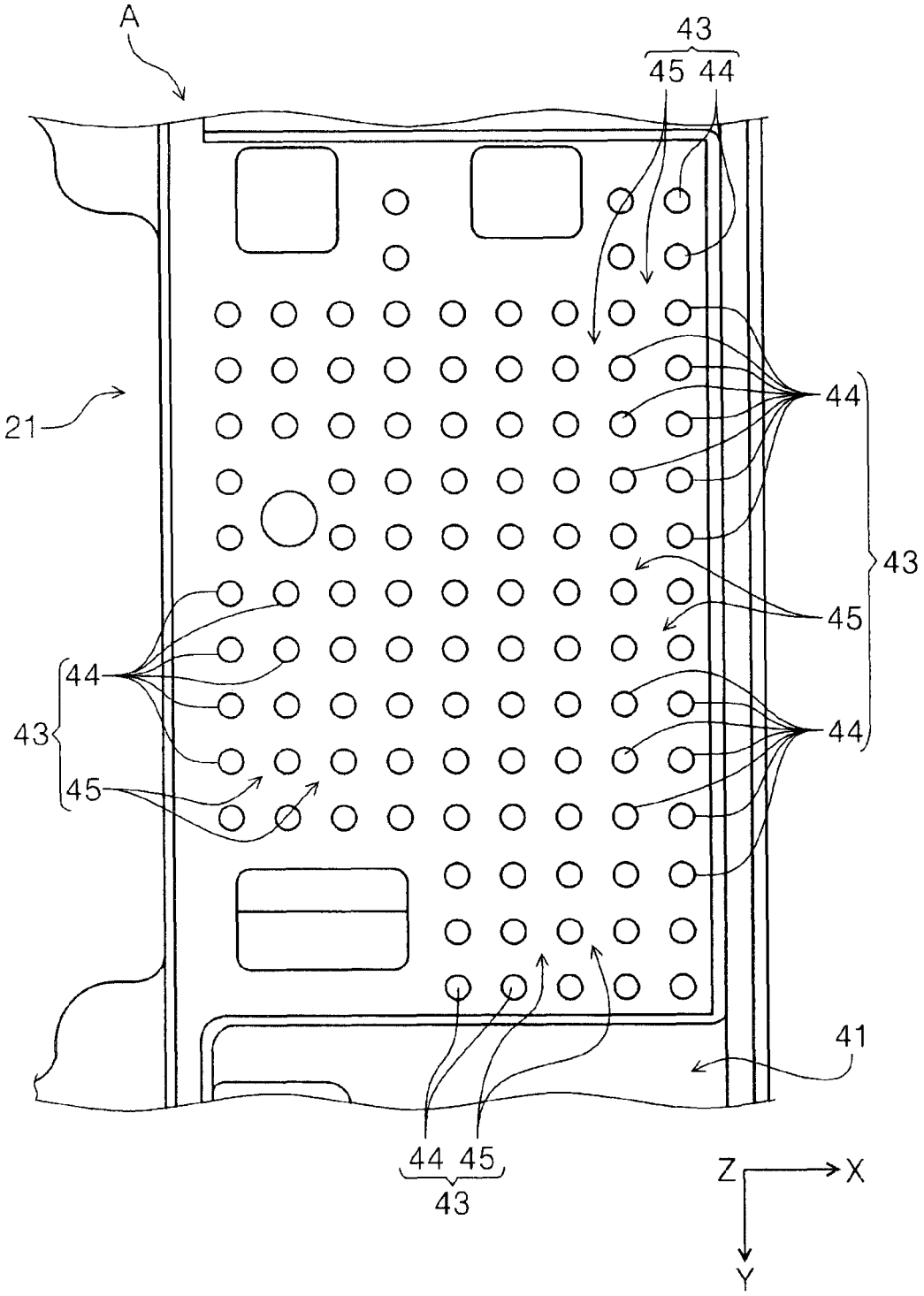
FIG. 12 is a diagram illustrating an example of a liquid dripping suppression section.

As one example of the liquid dripping suppression section, a concave and convex shaped portion 43, as a concave and convex shaped portion provided in the bottom face portion 41 of the carriage 21, will be described with reference to FIG. 12. FIG. 12 is a diagram illustrating one example of the liquid dripping suppression section.

The carriage 21 includes the concave and convex shaped portion 43 configured to be capable of retaining ink in at least one portion of the bottom face portion 41 utilizing surface tension. In the present embodiment, the concave and convex shaped portion 43 is provided in the above-mentioned portion that is brought into contact with the second absorbing member 42, that is, the portion A (FIG. 8) of the bottom face portion 41, which is located on the +X-axis direction side of the nozzle forming face 29 illustrated in FIG. 8.

More specifically, the concave and convex shaped portion 43 (FIG. 12) is configured to include a plurality of convex-shaped portions 44 and a concave-shaped portion 45. The convex-shaped portions 44 protrude relative to the bottom face portion 41, and the concave-shaped portion 45 is more concave than the convex-shaped portions 44. In the present embodiment, the concave-shaped portion 45 is approximately flush with the bottom face portion 41. The plurality of convex-shaped portions 44 are disposed at narrow intervals enough to allow a portion included in the concave-shaped portion 45 and located between every two adjacent convex-shaped portions 44 to retain the ink utilizing the surface tension. More specifically, the concave and convex shaped portion 43 can be formed by embossing or surface texturing of the bottom face portion 41.

The above configuration that allows the concave and convex shaped portion 43 capable of retain the ink utilizing the surface tension to be provided in the bottom face portion 41 of the carriage 21 further reduces the risk that the ink having been adhered on the bottom face portion 41 of the carriage 21 drips down.

Example 2 of Liquid Dropping Suppression Section

Figure 13:
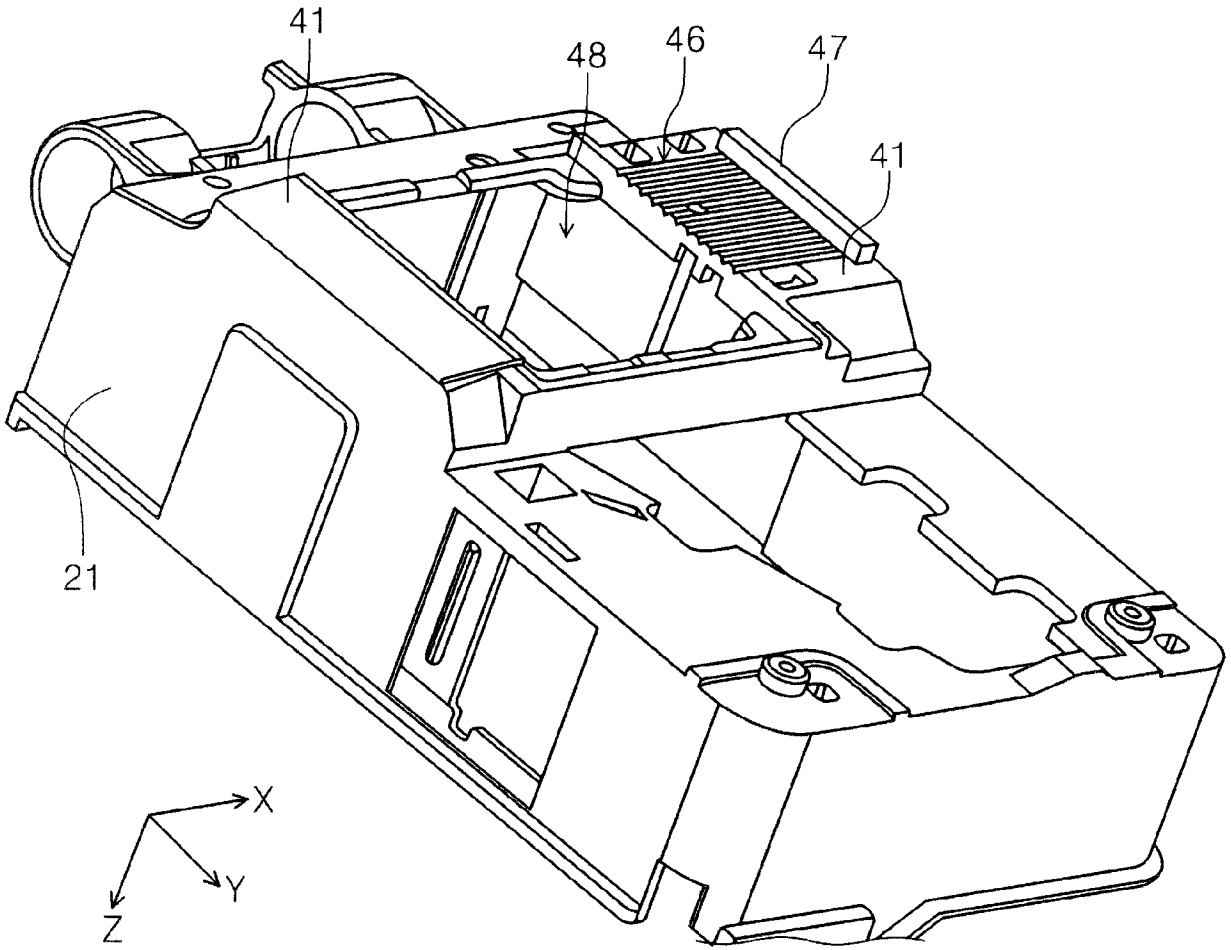
FIG. 13 is a diagram illustrating another example of the liquid dripping suppression section.

As another example of the liquid dripping suppression section, groove portions 46 and a third absorbing member 47 will be described with reference to FIG. 13. The groove portions 46 and the third absorbing member 47 are provided in the bottom face portion 41 of the carriage 21. FIG. 13 is a diagram illustrating another example of the liquid dripping suppression section.

The plurality of groove portions 46 and the third absorbing member 47 that is provided on the bottom face portion 41 are provided in at least one portion of the bottom face portion 41 of the carriage 21. The groove portions 46 are configured to guide the liquid having been adhered on the bottom face portion 41 toward the third absorbing member 47. Specifically, the third absorbing member 47 is provided in such a way as to be in contact with one side (+X-axis direction side) end portions of the groove portions 46.

The mist having been adhered on the bottom face portion 41 of the carriage 21 accumulates in the groove portions 46 because of the surface tension, and thus, this configuration reduces the risk that the mist gathers and forms liquid droplets, and the formed liquid droplets drip down. Moreover, the liquid droplets having accumulated in the groove portions 46 are guided to the third absorbing member 47 and are absorbed by the third absorbing member 47, and thus, this configuration further reduces the risk of the liquid dripping.

In this example as well, the groove portions 46 and the third absorbing member 47 are provided in a portion included in the bottom face portion 41 (the portion being denoted by the reference sign A in FIG. 8) and located on the +X-axis direction side of the nozzle forming face 29 illustrated in FIG. 8. In FIG. 13, a portion denoted by a reference sign 48 corresponds to an opening 48, and the nozzle forming face 29 of the recording head 20 is exposed through this opening 48. Naturally, a configuration in which the above liquid dripping suppression section is disposed in a different portion of the bottom face portion 41 is also applicable.

Regarding Fourth Absorbing Member

Figure 17:
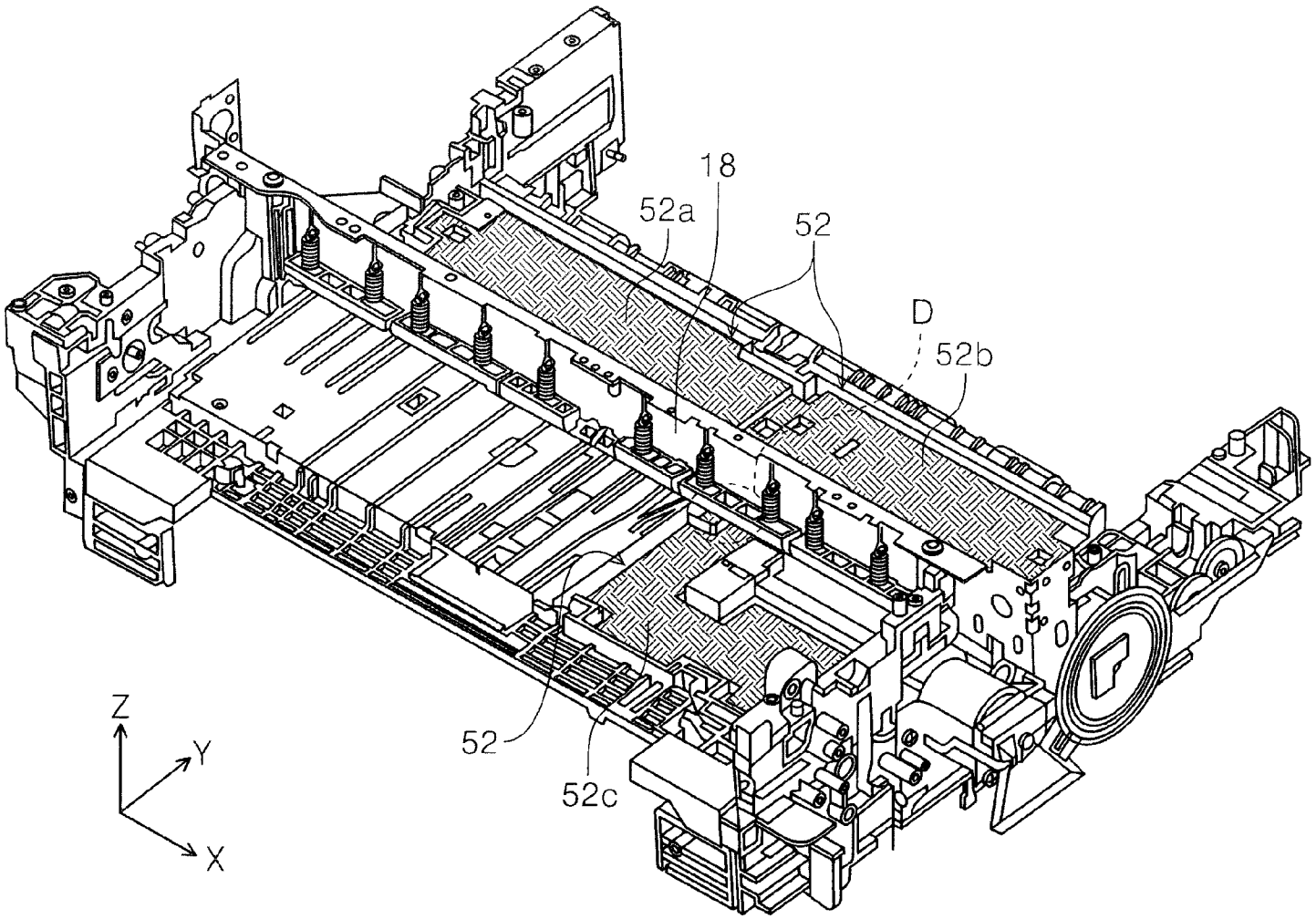
FIG. 17 is a diagram illustrating a fourth absorbing member.

A fourth absorbing member 52, as a fourth absorbing member provided below the medium supporting portion 22 including the first absorbing member 40, will be described with reference to FIG. 17. FIG. 17 is a diagram illustrating the fourth absorbing member. The fourth absorbing member 52 is provided below the medium supporting portion 22, and is configured such that the fourth absorbing member 52 receives waste ink exceeding an amount of ink that the first absorbing member 40 is capable of absorbing.

In the present embodiment, the fourth absorbing member 52 is separated into three absorbing members, that is, an absorbing member 52*a*, an absorbing member 52*b*, and an absorbing member 52*c*. The absorbing member 52*a* and the absorbing member 52*b* among the absorbing member 52*a*, the absorbing member 52*b*, and the absorbing member 52*c*, which constitute the fourth absorbing member 52, are provided at positions corresponding to the medium supporting portion 22 (FIG. 4), that is, the +Y-axis direction side of the guide frame 18 illustrated in FIG. 17 (also see FIG. 4).

Further, the absorbing member 52*c* is provided in a portion that is located on the −Y-axis direction side of the guide frame 18 and that is located on the +X-axis direction side in the apparatus width direction just like the absorbing member 52*b*. Further, the absorbing member 52*c* is in contact with the absorbing member 52*b* in a portion denoted by a reference sign D and located below the guide frame 18 in FIG. 17.

Although, in order to replace the fourth absorbing member 52, members disposed above the fourth absorbing member 52 are necessary to be disassembled, since, as described above, the fourth absorbing member 52 is separated into the plurality of absorbing members, only an absorbing member having absorbed a large amount of ink can be replaced, that is, all of the members disposed above the fourth absorbing member 52 are not necessary to be disassembled, and thus, this configuration facilitates the operation of replacing the fourth absorbing member 52.

Further, there is a case where a flushing operation is performed at a position on the +X-axis direction side opposite the home position of the carriage 21 (the position at which the carriage 21 is located in FIG. 4) within the reciprocation region of the carriage 21, and in such a case, a large amount of waste ink is ejected at a position corresponding to the absorbing member 52*b*. Thus, as a result, the absorbing member 52*b* absorbs a large amount of ink.

The configuration in which the absorbing member 52*c* being in contact with the absorbing member 52*b* is provided at a position below the guide frame 18 enables the increase of an ink absorbing capacity on the +X-axis direction side where an amount of waste ink to be absorbed is large.

Further, in the case where the ink absorbing ability of the absorbing members 52*b* and 52*c* has reached its limit, for example, operations of disassembling members disposed above the absorbing member 52*b* and replacing only the absorbing member 52*b* allow the absorbing member 52*b* to absorb ink having been absorbed by the absorbing member 52*c*, thus enabling the ink absorbing ability of the absorbing members 52*b* and 52*c* to be restored. Similarly, the replacement of only the absorbing member 52*c* brings about the same operational advantage.

The entire disclosure of Japanese Patent Application No. 2017-136299, filed Jul. 12, 2017 is expressly incorporated by reference herein.

What is claimed is:

1. A recording apparatus comprising:

a recording head including nozzles through which liquid is ejected onto a transported medium; and an electric field forming section including a conductive member and configured to, upon supply of a voltage to the conductive member, form an electric field between a nozzle forming face of the recording head and a nozzle facing portion facing the nozzle forming face, wherein the conductive member includes at least one first portion and a second portion, each of the at least one first portion being disposed at a position being nearer the recording head than a position of the second portion and included in a corresponding one of at least one liquid discarding region which, in an execution of borderless recording for ejecting the liquid onto both of an outside and an inside of each of at least one edge among edges of the medium, is used for the ejection of the liquid onto the outside of a corresponding one of the at least one edge whose position corresponds to each of at least one predetermined size of the medium, the second portion being disposed in a recording region other than the at least one liquid discarding region, wherein a strength of the electric field associated with the at least one first portion is greater than a strength of the electric field associate with the second portion with a constant voltage applied to the conductive member.

2. The recording apparatus according to claim 1, further comprising a first absorbing member provided on a side of the nozzle facing portion and configured to absorb the liquid.

3. The recording apparatus according to claim 2, wherein the conductive member is provided between the first absorbing member and the recording head.

4. The recording apparatus according to claim 1, further comprising:

a carriage including a bottom face portion provided with at least one portion through which the nozzle forming face of the recording head is exposed, the carriage being configured to reciprocate in a scanning direction of the recording head; and a second absorbing member provided within a region of the reciprocation of the carriage and configured to absorb the liquid, wherein the carriage is configured to be displaced in a direction in which the nozzle forming face advances/retracts relative to the nozzle facing portion, and has an advanced state in which at least one portion of the bottom face portion is in contact with the second absorbing member, and a retracted state in which the bottom face portion is retracted from a position of the advanced state to a position away from the second absorbing member.

5. The recording apparatus according to claim 4, wherein, within the region of the reciprocation of the carriage, the second absorbing member is disposed on a second end side located opposite a first end side on which a home position of the carriage is provided, and wherein, in the advanced state, the second absorbing member is in contact with a portion constituting the bottom face portion of the carriage and located further toward the second end side than the nozzle forming face.

6. The recording apparatus according to claim 1, further comprising a recording unit including a bottom face portion provided with at least one portion through which the nozzle forming face of the recording head is exposed, wherein a concave and convex shaped portion configured to retain the liquid utilizing surface tension is provided in at least one portion of the bottom face portion of the recording unit.

7. The recording apparatus according to claim 1, further comprising a recording unit including a bottom face portion provided with at least one portion through which the nozzle forming face of the recording head is exposed, wherein at least one groove portion is provided in at least one portion of the bottom face portion of the recording unit, and a third absorbing member is provided in the bottom face portion, and wherein the at least one groove portion is configured to guide liquid having been adhered on the bottom face portion to the third absorbing member.

8. The recording apparatus according to claim 1, wherein a second conductive member is provided between the recording head and the conductive member.

* * * * *